US007241066B1

(12) United States Patent
Rosen et al.

(10) Patent No.: US 7,241,066 B1
(45) Date of Patent: Jul. 10, 2007

(54) CONTAINER FOR FLOWABLE PRODUCTS

(75) Inventors: Ian K Rosen, North Muskegon, MI (US); Logan D Pitts, North Muskegon, MI (US)

(73) Assignee: American Grease Stick Company, Muskegon, MI (US)

( * ) Notice: Subject to any disclaimer, the term of this patent is extended or adjusted under 35 U.S.C. 154(b) by 225 days.

(21) Appl. No.: 10/818,775

(22) Filed: Apr. 6, 2004

Related U.S. Application Data

(60) Provisional application No. 60/492,203, filed on Aug. 1, 2003, provisional application No. 60/462,836, filed on Apr. 15, 2003.

(51) Int. Cl.

| | |
|---|---|
| ***B43M 11/06*** | (2006.01) |
| ***B43K 5/14*** | (2006.01) |
| ***A46B 11/00*** | (2006.01) |
| ***B65D 47/10*** | (2006.01) |
| ***B65D 85/00*** | (2006.01) |

(52) U.S. Cl. ..... 401/183; 401/132; 401/268; 206/459.5; 222/106; 222/541.6

(58) Field of Classification Search ..... 401/37, 401/39, 137, 139, 183, 132, 268; 222/23, 222/94, 106, 107, 192, 541.6; 206/459.5, 206/484; 383/39, 40

See application file for complete search history.

(56) References Cited

U.S. PATENT DOCUMENTS

| | | | | |
|---|---|---|---|---|
| 301,977 | A | 7/1884 | French | |
| 571,521 | A * | 11/1896 | Heberline et al. | 206/459.5 |
| 1,994,764 | A | 3/1935 | Greedy | |
| 2,637,872 | A | 5/1953 | Holbrook | |
| RE24,251 | E | 12/1956 | Kaplan et al. | |
| 2,896,381 | A | 7/1959 | Lange | |
| 3,009,498 | A | 11/1961 | Fohr | |
| 3,128,920 | A | 4/1964 | Volckening et al. | |
| 3,163,971 | A | 1/1965 | Loliger et al. | |
| 3,179,286 | A | 4/1965 | Morceau | |

(Continued)

FOREIGN PATENT DOCUMENTS

| | | | |
|---|---|---|---|
| JP | 57023666 | A | 2/1982 |

OTHER PUBLICATIONS

Exhibits A-D include photos of various packets believed to be on sale more than one year prior to the filing date of this application.

*Primary Examiner*—David J. Walczak
(74) *Attorney, Agent, or Firm*—Van Dyke, Gardner, Linn & Burkhart, LLP

(57) ABSTRACT

A compartmentalized container for holding and dispensing flowable material and method for making such a compartmentalized container includes opposite sheet portions selectively sealed together to define a plurality of single use dispensers and a header portion that is integral with the dispensers. Each of the dispensers includes a closed cavity defined by an area of the sheet portions that is not sealed together. Each of the dispensers is separable from the container and openable to dispense the flowable material from a respective one of the cavities. The dispensers may be separable from the container via cutting or tearing the dispensers from one another or from the header portion. The header portion may include product information and may include a means for hanging the container. Each of the dispensers may include an applicator brush formed or defined at an edge portion of the dispenser.

58 Claims, 14 Drawing Sheets

U.S. PATENT DOCUMENTS 3,184,121 A 5/1965 Volckening
3,189,227 A 6/1965 Hobbs et al.
3,224,640 A 12/1965 Schneider et al.
3,524,537 A 8/1970 Winter
3,741,778 A * 6/1973 Rowe ..... 426/107
3,783,581 A 1/1974 Pierce
3,789,569 A 2/1974 Egger
3,815,794 A 6/1974 Carlisle
3,862,684 A 1/1975 Schmitt
3,865,157 A 2/1975 Knabe et al.
3,878,977 A 4/1975 Carlisle
3,911,642 A 10/1975 Ernstsson et al.
3,913,734 A 10/1975 Siegel
3,922,835 A 12/1975 Reil
3,971,149 A 7/1976 Tanney
4,045,939 A 9/1977 Baumstingl
4,163,509 A 8/1979 Amneus
D253,040 S * 10/1979 Fournier et al. ..... D9/722
4,199,915 A 4/1980 Levine
4,252,257 A 2/1981 Herzig
4,328,912 A 5/1982 Haggar et al.
4,417,607 A 11/1983 Scholle et al.
4,491,245 A 1/1985 Jamison
4,548,606 A * 10/1985 Larkin ..... 604/414
4,566,249 A 1/1986 Schwerdtel et al.
4,671,452 A 6/1987 Pupp et al.
4,683,701 A 8/1987 Rangwala et al.
4,707,334 A 11/1987 Gerhard
4,769,974 A 9/1988 Davis
4,921,137 A 5/1990 Heijenga
4,988,016 A 1/1991 Hawkins et al.
5,018,646 A 5/1991 Billman et al.
5,020,303 A 6/1991 Vokins
5,029,430 A 7/1991 Davis
5,072,855 A 12/1991 Herzig
5,111,932 A * 5/1992 Campbell ..... 206/216
5,368,828 A 11/1994 Carlson
5,377,475 A 1/1995 Haarer et al.
5,398,734 A 3/1995 Hartel
D368,428 S 4/1996 Croft
5,529,224 A 6/1996 Chan et al.
5,660,100 A 8/1997 Spelten et al.
5,839,609 A 11/1998 Zakensberg
5,897,833 A * 4/1999 Hunt et al. ..... 422/28
5,971,225 A 10/1999 Kapsa
5,996,845 A 12/1999 Chan
6,094,887 A 8/2000 Swank et al.
6,096,265 A 8/2000 Mezger et al.
6,120,730 A 9/2000 Palaniappan et al.
6,129,959 A 10/2000 Mercer et al.
6,199,719 B1 3/2001 Bordage
6,247,617 B1 * 6/2001 Clyde et al. ..... 222/94
6,431,227 B1 8/2002 Ter Haar
6,557,731 B1 5/2003 Lyon et al.
6,622,457 B2 9/2003 Kurth
6,626,296 B1 9/2003 Jimu et al.
6,629,401 B1 10/2003 Hins et al.
6,666,002 B1 12/2003 Otsuka et al.
6,691,747 B1 2/2004 Marcus et al.
6,718,735 B2 4/2004 Lewis, Jr. et al.
6,752,959 B2 6/2004 Smith et al.
6,786,249 B2 9/2004 Armbruster et al.
6,786,515 B2 9/2004 Franko, Sr.
6,860,513 B2 3/2005 Kaufman
2002/0029543 A1 3/2002 Taggart
2002/0083682 A1 7/2002 Edwards et al.
2003/0140532 A1 * 7/2003 Deuerling ..... 40/312

* cited by examiner

CONTAINER FOR FLOWABLE PRODUCTS

CROSS REFERENCE TO RELATED APPLICATIONS

The present application claims benefit of U.S. provisional applications, Ser. No. 60/462,836, filed Apr. 15, 2003, and Ser. No. 60/492,203, filed Aug. 1, 2003, which are hereby incorporated herein by reference in their entireties.

FIELD OF THE INVENTION

The present invention relates generally to containers and, more particular, to containers for storing liquids, creams, gels, oils, greases, adhesives, and other types of flowable and dispensable materials.

BACKGROUND OF THE INVENTION

In the past, flowable materials have often been stored in individual packets that consist of two flexible foil sheets secured together about their periphery to define a cavity between the sheets. The cavity is filled with whatever material is being stored. Such packets find widespread use for storing food condiments, such as ketchup, mustard, mayonnaise, and other liquid or semi-liquid foods. When it is time to access the contents of the packet, the user simply tears off a corner portion of the foil material and squeezes out the contents. The use of such packets as storage vessels, however, has suffered from a number of disadvantages. Often times the user of such a packet ends up spilling the contents of the packet onto their fingers. Alternatively, the contents may end up dribbling down the side of the packet. This presents the user with the undesirable options of having to either scrape the contents off the packet onto the intended object, or discard the packet with a substantial amount of the contents being left unused on the packet itself.

Other disadvantages of prior art packets include the difficulty of applying the contents of the packet precisely to a desired location. For example, when a person opens up a conventional ketchup packet, it is difficult to predict exactly where the ketchup may squirt out of the packet upon compression of the packet. This, of course, can lead to ketchup being applied to undesired objects. The user of condiment packages is also problematic because there are typically no structures on the packet that define the size of the outlet that is created when the user tears off a corner of the packet. In some instances the user might only tear off a small corner, creating a very small outlet. This can cause the user to have to squeeze the container excessively to expel the contents, as well as causing the contents to squirt out of the packet a considerable distance. In other instances, an excessively large portion of the packet may be torn off, creating a large outlet orifice. This can lead to the contents immediately exiting the packet during the tearing off process, which typically causes the contents to spill onto the user's hands.

In addition to the conventional packets used to store condiments, a wide variety of other types of containers have been used in the past to store other types of flowable materials. Many of these other types of containers have suffered from other disadvantages. For example, a large number of containers for flowable material are made from molded plastic and the cost of the container can be a significant component of the overall cost of the product. In fact, in some cases, the container may cost as much as or more than the contents in the container. This not only causes increased costs to the consumer of the product, but can also lead the manufacturer to limit the marketing of their product to container sizes that may be too large for many situations in which their product is used.

As but one example, automotive brake fluid is often sold in containers that hold about eleven ounces or more of fluid. In certain situations, however, such as where brake fluid is being bled off to remove any air bubbles in the brake system, a person may only need to use about three to four ounces of brake fluid. Selling a container of three or four ounces of brake fluid, however, may not be economical to the manufacturer of the brake fluid, because the cost of the container may be so high as to not allow the manufacturer to sell the three to four ounce container for any meaningfully less amount of money than what the eleven to twelve ounce container is sold for. A consumer confronted with a three ounce container that costs pretty much the same as a twelve ounce container would undoubtedly tend to choose the large container for purchase. The smaller containers would therefore not likely be purchased, and the consumer may end up with more product than is necessary for his or her task. This can lead to wasting of the product, or messy attempts to save the unused contents in the container for later use. For some products, such as brake fluid, the contents may degrade over time if exposed to air, and an unwary consumer might end up putting degraded brake fluid into their automotive system. The economic difficulties of prior containers therefore can lead to a variety of different problems and disadvantages. The desire for a container that overcomes or alleviates such disadvantages can be seen.

Also, quick drying adhesives, such as Super Glue, Krazy® Glue or the like, which often contain ethyl (or methyl) cyanoacrylate or the like, are often moisture curing adhesives and, thus, bond rapidly in the presence of moisture, such as when dispensed from a sealed container onto an item exposed to the environment. Sometimes, anaerobic adhesives (which cure in the absence of air) or other solvents and air-curing compounds may also be used as quick setting or quick drying adhesives. Such quick drying adhesives may cure once dispensed from their sealed container and thus work almost the opposite of other types of air-curing adhesives, such as solvent-based adhesives and epoxy adhesives that involve two components to activate the curing process. Such quick drying adhesives are typically provided in containers having a screw cap at a dispensing end of the container. The containers are intended for multiples uses and the screw cap is intended to reseal the containers after each use. However, the quick drying capability of such adhesives results in various problems in providing a tube of adhesive that may be used multiple times because the screw-on cap that is typically provided with such tubes of adhesive bonds to the tube after a single use or application. Various bond-breaking devices have been developed to facilitate multiple uses of the multiple application tubes that often contain four to eight grams of adhesive.

Because the glue containers often result in only a single use, multiple containers are often sold in a package. The multiple containers are separate dispensers, each with a screw cap or the like for attempting to seal the container after the first use. It is known to make very small, single use tubes of such glue or adhesive. Some manufacturers have developed "single" use tubes in the 0.3 to 0.5 gram range so that the small tubes can be disposed of after use, without any re-capping and sealing problems. However, the single use tubes are substantially similar in design and appearance and overall structure to the multi-use tubes and each include a plastic or metal tube, a label and a cap. The dispensing end of the single use tubes may be removed to access and pierce a foil cap or end portion of the container, whereby the dispensing tip may be reattached or screwed onto the container for dispensing adhesive therefrom. After a single use, the container may be discarded or thrown away.

During manufacture of such single use tubes, each tube undergoes a separate filling operation to fill the tube with adhesive, and then several tubes are packed into a box and/or plastic bubble which is attached to a cardboard display card with a hang-up hole or the like, graphics, UPC code and any appropriate information and/or warning labels. Although the single use tubes reduce the amount of waste of the adhesive that is typically encountered with the multiple use tubes, the single use tubes individually may cost about fifty percent as much to manufacture as the multiple use tubes (because they are similar in design to the multiple use tubes) while providing only about ten percent of the adhesive content. Also, it is difficult to provide the required warning labels and product information that is typically required for the quick drying adhesives on the outer surface of the separate small tubes.

Additionally, the smaller single use tubes may require special packaging to hold two or more of the single use tubes for sale to the customer and for storage at the customer's home. For example, it is known to provide a plastic hinged box that may contain four tubes, whereby each of the tubes is snapped into corresponding projections formed in at least one side of the plastic hinged box. While such a device provides a convenient storage container, the costs associated with manufacturing such a container substantially limit the practicality of the tubes. Because the small tubes and packages may cost as much as the larger, multiple use tubes, there is little advantage to the consumer in purchasing the smaller tubes.

Therefore, there is a need in the art for product containers and dispensers which overcome the shortcomings of the prior art.

SUMMARY OF THE INVENTION

Accordingly, the present invention provides a method and device for economically packaging flowable material in a user-friendly and cost-efficient manner. The pouches of the present invention provide a variety of different features that facilitate opening the pouch and applying its contents, as well as sealing the opened pouch for later re-use, if necessary. The pouches can be manufactured at significantly reduced prices in comparison to prior art containers, thereby allowing the manufacturer greater leeway in offering different sizes of containers for sale. The packets of the present invention may provide two or more pouches of product, and may provide different products, with the same container or packet.

The present invention also provides a plurality of single use adhesive dispensers for dispensing a quick-drying type of adhesive, such as an adhesive containing ethyl or methyl cyanoacrylate or the like, or other types of adhesives of flowable materials or fluids, such as paint, grease or the like. The single use dispensers are formed on a common sheet or container, which may comprise a pair of sheets or sheet portions selectively sealed together to define multiple cavities or pockets or containers for holding or containing adhesive or other flowable material. The individual containers or dispensers may be separated from the others by a user to provide a single use adhesive dispenser for dispensing a small amount of adhesive therefrom. The sheet or sheets may include a header portion adjacent to one of the dispensers for hanging the dispensers and for providing product information and/or warning labels.

According to an aspect of the present invention, a compartmentalized container for containing at least one flowable material is formed from opposite sheet portions selectively sealed together to define a header portion and first and second dispensers. The opposite sheet portions of the header portion are substantially sealed together, and at least one side of the header portion provides information about the flowable material. The first dispenser is adjacent to the header portion, with the opposite sheet portions of the first dispenser being selectively sealed together to define a closed cavity for containing the flowable material where the sheets are not sealed together. The opposite sheet portions of the second dispenser are selectively sealed together to define a closed cavity (where the sheets are not sealed together) for containing the flowable material. The header portion and the first and second dispensers are integrally formed by the opposite sheet portions.

The flowable material may comprise a quick drying adhesive. The dispensers may be separable from one another, such as via tearing or cutting between the cavities and dispensers, such as along a perforated joint between adjacent ones of the adhesive dispensers, or along an indicating line printed on at least one of the sheets between adjacent ones of the adhesive dispensers.

The dispensers may include a dispensing tip at one end that may be defined by a narrow end portion of the cavity. The dispenser may then be opened by cutting or tearing the sheets at the dispensing tip. The dispensers may include an applicator brush or the like formed or defined on the dispensers, such as at the end of the dispenser opposite the dispensing tip or elsewhere on or around the dispenser. The applicator brush may comprise an edge of the sheets, and may comprise a roughened edge or serrated edge or otherwise raised or roughened edge or surface to facilitate spreading of the flowable material after it has been dispensed.

The header portion may include at least some printed information about the flowable material contained within the dispensers, such as product information or warning labels or bar code information or the like. The header portion may also include a means for hanging the compartmentalized container, such as a hole or hook or the like at an upper end of the header portion. The container thus provides a unitary or integral container having a header portion attached to or integral with multiple dispensers. The integral container of the present invention thus provides multiple dispensers that are readily displayed and/or hung at a store, without requiring special, costly packaging to keep the dispensers together.

According to another aspect of the present invention, a method of forming a container having a plurality of single use dispensers integrally formed with the container includes providing two sheet portions and sealing a portion of the sheet portions together to define a header portion of the container. The sheet portions are selectively sealed together to define multiple cavities between the sheet portions, with each of the multiple cavities being generally surrounded by sealed portions of the sheet portions and the header portion being adjacent to at least one of the cavities. A flowable material, such as a quick drying adhesive, is injected into the multiple cavities, which define multiple adhesive dispensers. The flowable material or quick drying adhesive may be generally simultaneously injected into the multiple cavities with multiple injectors, or may be injected separately into each individual cavity.

According to another aspect of the present invention, a pouch for flowable material is provided. The pouch includes first and second flexible sheet portions that are attached to each other generally about an outer periphery. A cavity is defined between the first and second flexible sheet portions. The cavity includes a neck portion and a body portion. The neck portion has a narrower width than the body portion and is located adjacent the outer periphery of the sheets. Flowable material is hermetically stored in the cavity and the sheets are made of a tearable material adapted to allow a user to tear off a part of the sheet portions that intersect the neck portion and thereby allow the flowable material to flow out of the pouch through the neck portions. A picture of a conventional container, such as a conventional can, bottle, or tube is also printed on an external side of the first sheet portion. The container picture includes a body, a neck, and a graphic cap or seal at the end of the neck. The neck picture is positioned on top of the actual neck portion of the cavity so that the neck picture and the exit orifice of the actual neck portion are aligned with each other. The neck picture thus provides a visual aid to help direct application of the cavity contents.

According to another aspect of the present invention, a pouch is provided that includes first and second flexible sheet portions secured together generally about their periphery to define a cavity therebetween. Flowable material is hermetically stored with the cavity, and the contents of the cavity may be accessed by tearing off a portion of either or both of the first and second flexible sheet portions. A picture of a conventional container is printed on the external side of at least one of the flexible sheet portions. The picture has a size and shape that are substantially the same as the size and the shape of the cavity, and the picture is positioned to be substantially aligned with the underlying cavity. The picture preferably includes a graphic cap or seal that overlaps an actual exit spout that is in fluid communication with the cavity and that defines an exit orifice when the pouch is opened.

According to another aspect of the present invention, a pouch is provided that includes first and second flexible sheet portions secured together generally about their periphery to define a cavity therebetween. Flowable material is hermetically stored within the cavity, and the contents of the cavity may be accessed by tearing off a portion of either or both of the first and second flexible sheet portions. A score line and/or perforation is defined in at least one of the flexible sheet portions and may consist of a weakened section of material that is adapted to be severed more easily than along areas of the sheet portions. The score line is shaped to define a spout out of which the material can exit out of the cavity after the pouch has been torn along the score line.

According to another aspect of the present invention, a pouch is provided for storing a flowable material. The pouch includes first and second flexible sheet portions. The second flexible sheet portion is attached to the first sheet portion generally about the outer periphery of the first sheet portion and generally along an internal section of the first sheet portion to thereby define first and second chambers. The first and second chambers are separate and hermetically isolated from each other and ambient air. Both of the sheet portions are made of a tearable material that is adapted to allow a user to tear off a part of the sheet portions to thereby allow access to the flowable material in the chambers. The same flowable material is stored hermetically in both the first chamber and the second chamber.

According to yet another aspect of the present invention, a pouch is provided that includes first and second flexible sheet portions secured together generally about their periphery to define a cavity therebetween. Flowable material is hermetically stored with the cavity, and the contents of the cavity may be accessed by tearing off a portion of either or both of the first and second flexible sheet portions. The sheet portions each have a first width when they are laid flat, and a seam is defined along at least a first perimeter edge of the sheet portions. The seam connects the two sheet portions together and has a second width that is less than the first width. This reduced width of the seam allows for more space within the chamber and allows greater fill capacity of flowable material in a pouch.

According to still another aspect of the present invention, a pouch for brake fluid is provided. The pouch includes a first flexible sheet portion and a second flexible sheet portion. The second flexible sheet portion is attached to the first sheet portion generally about the outer periphery of the first sheet portion. A cavity is defined between the first and second flexible sheet portions. An amount of brake fluid is hermetically stored in the cavity defined between the first and second flexible sheet portions. The sheet portions are made of a tearable material that is adapted to allow a user to tear off a part of the first and second sheet portions to thereby allows access to the brake fluid in the pouch through an exit spout or aperture.

According to other aspects of the present invention, the sheet portions may be constructed of a single sheet folded over on itself and secured together along the outer periphery and regions outside of the fold. The sheet portions may also be made of a plastic or foil material. One or more score lines may be positioned adjacent to the neck portion of the cavity to indicate where the sheet portions can be severed to gain access to the contents in the cavity. The score lines may intersect the picture of the container printed on the side of the container to thereby provide a visual indication of how to gain access to the package's contents. The score lines may preferably intersect the picture of the container near the bottom of a cap pictured on the container to thereby provide an easy, visual indication of how to gain access to the contents.

The pouches of the present invention may be used to economically package a wide range of flowable materials. The close visual similarity of the graphical prints of conventional cans, bottles, and tubes on the pouch to actual structures provides an easy indicator to the consumer (based on their pre-learned methods of removing caps or seals from actual cans, bottles, and tubes) as to how the contents of the pouch are to be accessed. The graphics on the pouch also help the user to correctly apply the flowable material onto a desired object by providing a visual indicator as to the precise location of the exit orifice out of the pouch. Further, the pouches of the present invention can be manufactured economically, thereby allowing producers to offer small amounts of product to consumers with a more significant price reduction compared to larger amounts than has been available in the past. This is partially due to the elimination of expensive plastic or metal containers with caps, seals, labels, and the attendant costs of printing on the plastic or metal containers. These and other advantages of the present invention will be apparent to one skilled in the art upon review of the following specification and the accompanying drawings.

Therefore, the present invention provides for a plurality of single use dispensers which are formed on a single container or sheet. The single use dispensers may be removed from one another for use via tearing or cutting or otherwise removing the dispensers along a perforated or scored line or printed line or the like on the container. The container may comprise a pair of sheets or sheet portions of appropriate material sealed or joined together to define the separate cavities of the separate single use adhesive dispensers. The present invention thus provides multiple low cost, easy to use single use dispensers. The single use adhesive dispensers of the present invention not only avoid the need for costly packaging, but also do not require removable and reattachable caps or dispensing nozzles or the like. The containers or sheets may be printed in a manner to outline the cavities of the single use adhesive dispensers with a graphical printing or embossing that gives the appearance of a tube of adhesive.

The present invention thus reduces the number of components of the prior art tubes (that typically include the adhesive and a tube, cap and label and that are packaged in a box or bubble attached to a cardboard display card) to only two elements: the flat sheet stock and the adhesive (or other flowable material). The manufacturing of the multiple compartments of the container may be formed and filled generally simultaneously. As the multiple compartments are formed, the adhesive or flowable material may be simultaneously injected into the compartments with multiple injectors, whereby the product is sealed within the cavities of the container. The additional flat stock extension or header portion provides a means for hanging the container and provides a common billboard or label portion (in lieu of the bubble and cardboard card containers of the prior art) with graphics, warnings, UPC code and the like printed thereon. The savings over the separately formed and/or molded components (such as tubes, caps, labels, plastic bubbles, boxes and/or printed cardboard) may be substantial due to the simplified manufacturing and component costs, while the end product provides an effective and convenient single use container of quick drying tape adhesive.

These and other objects, advantages, purposes and features of the present invention will become more apparent upon review of the following specification in conjunction with the drawings.

DESCRIPTION OF THE PREFERRED EMBODIMENTS

Figure 2:
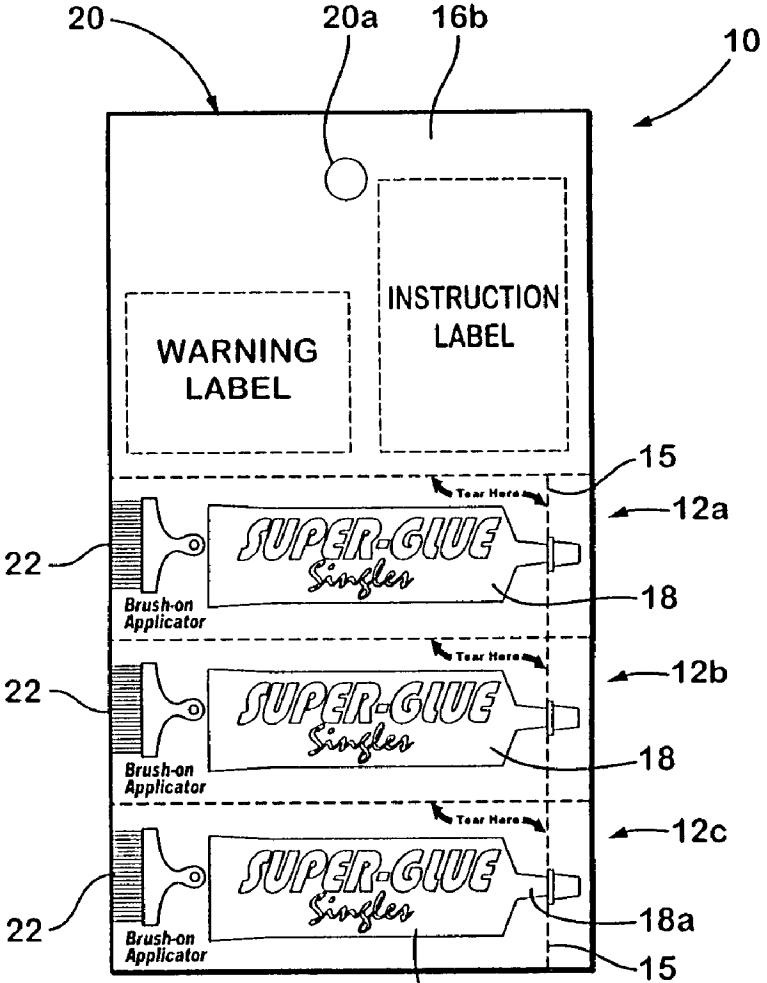
FIG. 2 is a plane view of the back side of the compartmentalized container of FIG. 1.

Referring now to the drawings and the illustrative embodiments depicted therein, a compartmentalized container 10 includes and defines a plurality of single use dispensers 12*a*, 12*b*, 12*c* (FIGS. 1 and 2), such as for adhesive or other flowable material. Each of the single use adhesive dispensers 12*a*, 12*b*, 12*c* has a cavity or pocket 18 for containing a small amount of adhesive therein. The adhesive dispensers may be separated from one another and opened to dispense adhesive from the respective cavity. The adhesive dispensers may contain a small amount of quick drying adhesive, such as ethyl cyanoacrylate or methyl cyanoacrylate or the like, which cures or dries or bonds quickly in the presence of moisture, or an anaerobic type adhesive, which cured in the absence of air, or other types of quick drying adhesives. After the single use application of the adhesive, the dispenser may be discarded or thrown away, with minimal waste of the adhesive. Alternately, the container may contain other flowable or dispensable products or materials, as discussed below.

Compartmentalized container 10 may comprise a pair of sheets of sheet portions 16*a* (FIG. 1) and 16*b* (FIG. 2) of printed flat stock or material, such as foil sheets or plastic or polymeric sheets or the like. The sheets 16*a*, 16*b* may comprise separate sheets sealed or joined or bonded together, or may comprise a single sheet folded over upon itself to form two adjacent sheets or sheet portions, without affecting the scope of the present invention. The sheets 16*a*, 16*b* may be selectively sealed or bonded or pressed or otherwise joined together to define compartmentalized container 10 and to define individual cavities 18 for containing adhesive. For example, the sheets may be heat sealed together (such as by joining or sealing the sheets together by heating the sheets while they are mated or pressed together) to define the separate cavities. The cavities 18 may be defined by areas of the sheets that are not sealed or joined or bonded together, such that the desired adhesive may be injected or provided or filled into the cavities, such as before or as the sheets are sealed together, whereby the individual cavities contain a small amount of adhesive therein. The cavities are designed to hold a small amount of adhesive, such that little adhesive will be wasted after a single use and after the individual dispensers are discarded or thrown away. For example, in the illustrated embodiment, the cavities contain approximately 0.2 grams of adhesive, which is substantially less than conventional quick drying adhesive tubes, which typically contain about two grams of adhesive.

After the container 10 has been purchased by a consumer, each of the adhesive dispensers 12*a*, 12*b*, 12*c* may be torn or cut or otherwise separated from the others along a dividing or separating line 14 extending along at least one edge of the adhesive dispensers. The lines 14 may be perforated or scored or otherwise weakened or marked to facilitate tearing or cutting of the individual adhesive dispensers from the container 10. Optionally, the line 14 may be a printed line on one or both sides of the container, such that a user may cut along the line, such as with scissors or a knife or the like, to remove the individual adhesive dispensers from the container.

The cavity of each dispenser may be formed generally in the shape of a small typical adhesive dispenser, and may have a narrowed tip portion or dispensing tip 18*a* for dispensing adhesive from the dispenser. Optionally, the container may include another perforated or scored or otherwise marked or weakened line 15 along and end of the dispensing tips 18*a*, to facilitate tearing or cutting or ripping the tips 18*a* to open the single use dispensers for dispensing adhesive from the cavities.

The sheets 16*a*, 16*b* may comprise any suitable material, such as foil or plastic or polymeric material or the like, for containing and hermetically sealing the adhesive within the separate cavities of the container. The adhesive may comprise any fast drying type of adhesive, and thus does not require mixing with other materials for use. The foil sheets or the like may be sealed or joined or bonded or crimped or the like in the areas about the periphery of the cavities 18 to define the separate individual cavities or pockets for hermetically containing and sealing the adhesive therewithin. The exterior or viewable surfaces of the sheets may be printed or embossed or screened or the like, such that the cavities are positioned generally within an outline of a small adhesive tube. The printing may include a printed cap or the like at the end of the dispensing tips 18*a* of the dispensers 18 to provide visual aid to a user so the user can readily see where to cut or tear the dispenser to open the dispenser and dispense the adhesive from within the cavity. The individual pockets or cavities thus may be defined within the sealed or joined portions of the sheets, which may include printing or art work to facilitate separating, opening and using the individual dispensers, such as in the manner described below.

Figure 1:
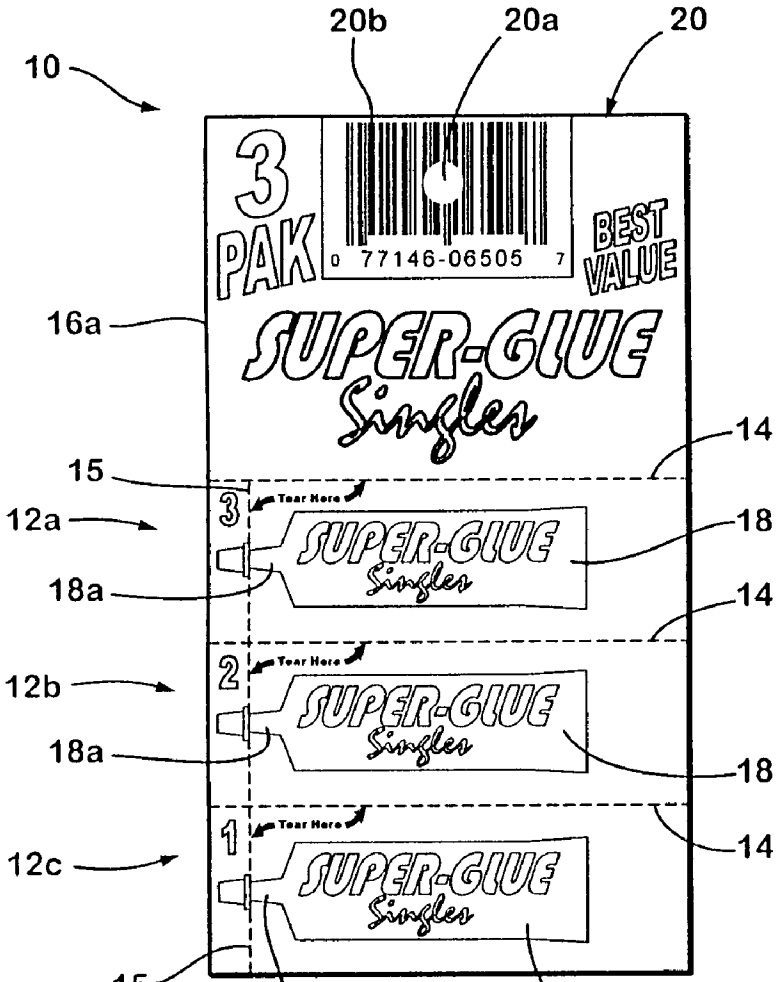
FIG. 1 is a plan view of a front side of the compartmentalized container in accordance with the present invention.

As shown in FIGS. 1 and 2, compartmentalized container 10 may also include a header portion 20, such as an upper end of the compartmentalized container 10. The header portion 20 is integral with and an extension of the sealed or joined sheets or sheet portions 16*a*, 16*b*, and may provide an advertisement or other information about the product contained within the adhesive dispensers. The header portion 20 and adhesive dispensers 12*a*, 12*b*, 12*c* thus may be formed as part of a unitary sheet or container or packet, whereby the adhesive dispensers may be removed from the container and from the header portion for use. As shown in FIG. 2, the backside of the header portion may provide important information about the product or adhesive contained within the adhesive dispensers attached to the header portion. Preferably, the header portion 20 may include an opening therethrough 20*a* or a hook or the like formed thereon or attached thereto for hanging the compartmentalized container 10 on a hook or post or the like at a store. As shown in FIG. 1, the opening or hole 20*a* may be positioned at and through the bar code label 20*b* for the container or product, such as in the manner described in U.S. provisional application, Ser. No. 60/482,680, filed Jun. 26, 2003 by Rosen for PACKAGE WITH APERTURE THROUGH PRICE CODE (Attorney Docket AME03 P-106), which is hereby incorporated herein by reference.

Optionally, and as shown in FIG. 2, each adhesive dispenser 12*a*, 12*b*, 12*c* may include an applicator portion 22, such as, for example, at an end 18*b* of the adhesive dispenser generally opposite the dispensing end or tip 18*a*. Applicator 22 may be a printed brush or spatula or applicator or spreader type design along the edge of the adhesive dispenser to indicate to a user that the edge is to be used to assist in applying or spreading the adhesive dispensed from the adhesive dispenser. Optionally, the applicator 22 may comprise a roughened edge of the adhesive dispenser, such as serrated edge, cut edge, raised surface or roughened surface or the like, or any combination of such surfaces or edges, to facilitate spreading of the adhesive dispensed from the dispenser.

Figure 3A:
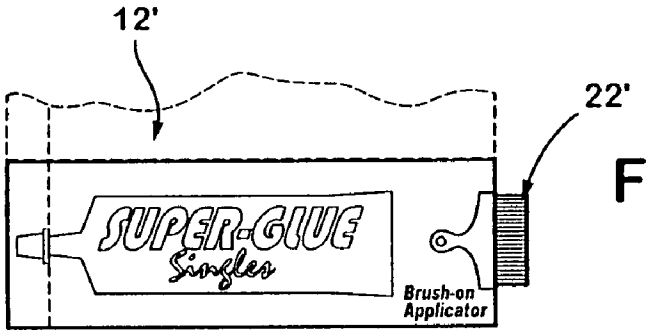
FIG. 3A is a plan view of a single use adhesive dispenser in accordance with the present invention.
Figure 3B:
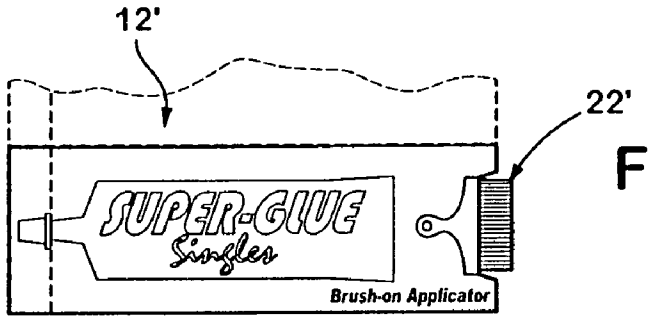
FIG. 3B is a plan view of another single use adhesive dispenser in accordance with the present invention.
Figure 3C:
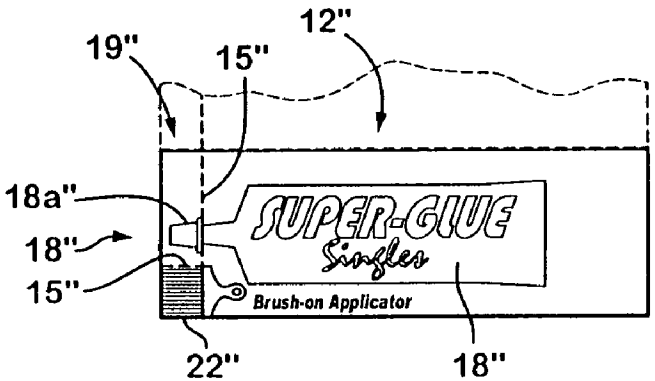
FIG. 3C is a plan view of another single use adhesive dispenser in accordance with the present invention.

Optionally, the applicator or brush or spatula or the like may be located at another location or region of the dispenser, such as along an edge of the dispenser or protruding from the dispenser or the like. For example, and as shown in FIGS. 3A and 3B, an applicator 22' may extend or protrude from a portion or region of an adhesive dispenser 12' to assist in using the applicator. The applicator may fully protrude from the end of the dispenser (such as shown in FIG. 3A) or may be formed as a partially protruding applicator (such as shown in FIG. 3B) which is formed and graphically depicted at the end of the dispenser. Optionally, and as shown in FIG. 3C, an applicator 22" may be at the dispensing end 18*c*" of an adhesive dispenser 12". For example, the dispensing end 18*c*" may have a tear away or cut away portion 19 for opening the tip 18*a*" of the cavity 18" of the dispenser. The applicator 22" may be adjacent to the tear away portion 19", such that after the tear away portion 19" is removed (such as via cutting or tearing along the lines 15") to open the dispenser, the applicator 22 remains attached to the dispenser and protrudes from the dispensing end 18*c*" of the dispenser 12". The applicator 22" is thus readily available and usable at the dispensing tip 18*a*" of the dispenser to spread the adhesive as it is dispensed from the cavity of the dispenser. The applicator may include one or more roughened edges and may include graphics on one or both surfaces to depict a brush or spatula or the like in order to indicate or identify the intended function of the protrusion or tab or edge to a user of the single use adhesive dispenser.

Optionally, in order to have less surface area within the packet to limit moisture or reduce problems that may occur with the adhesives bonding to the inner surface of the packets, it is envisioned that the shape of the packet cavity may be modified or reduced in size. For example, the cavity may be formed to be substantially narrow along its length to provide a narrow tube or container for a small amount of adhesive, without affecting the scope of the present invention. This approach may also lend itself to providing multiple small packets (such as five or more) attached together and to a header portion or card, in order to provide a greater amount of packets, with each containing a small amount of adhesive therein.

Figure 5:
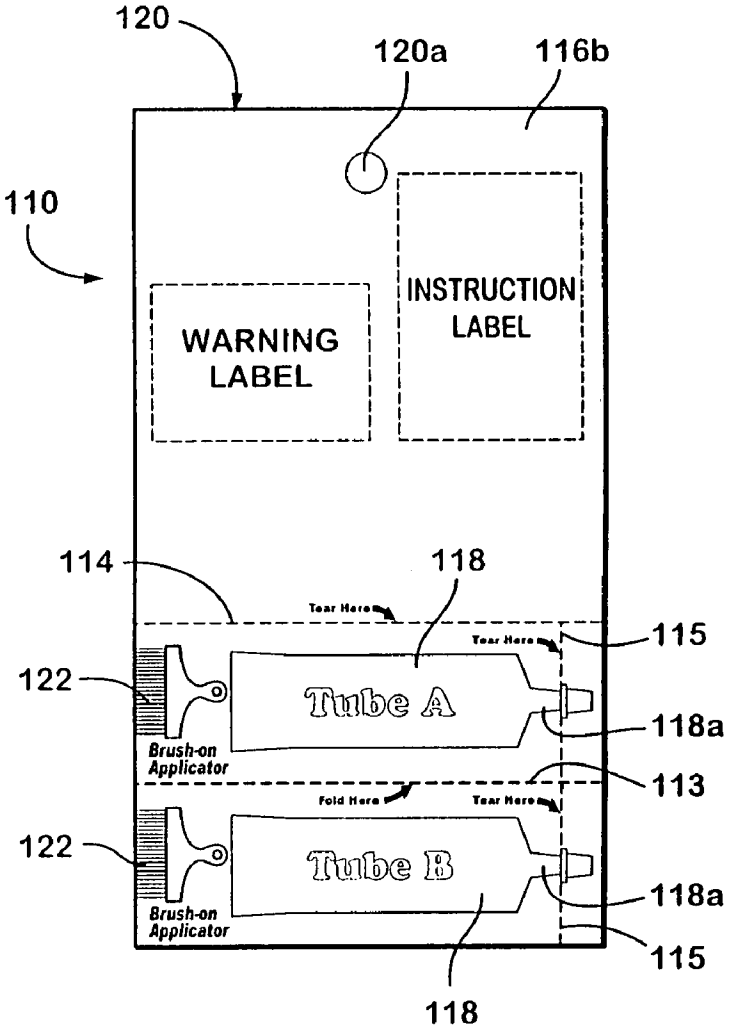
FIG. 5 is a plan view of the back side of the container of FIG. 4.
Figure 4:
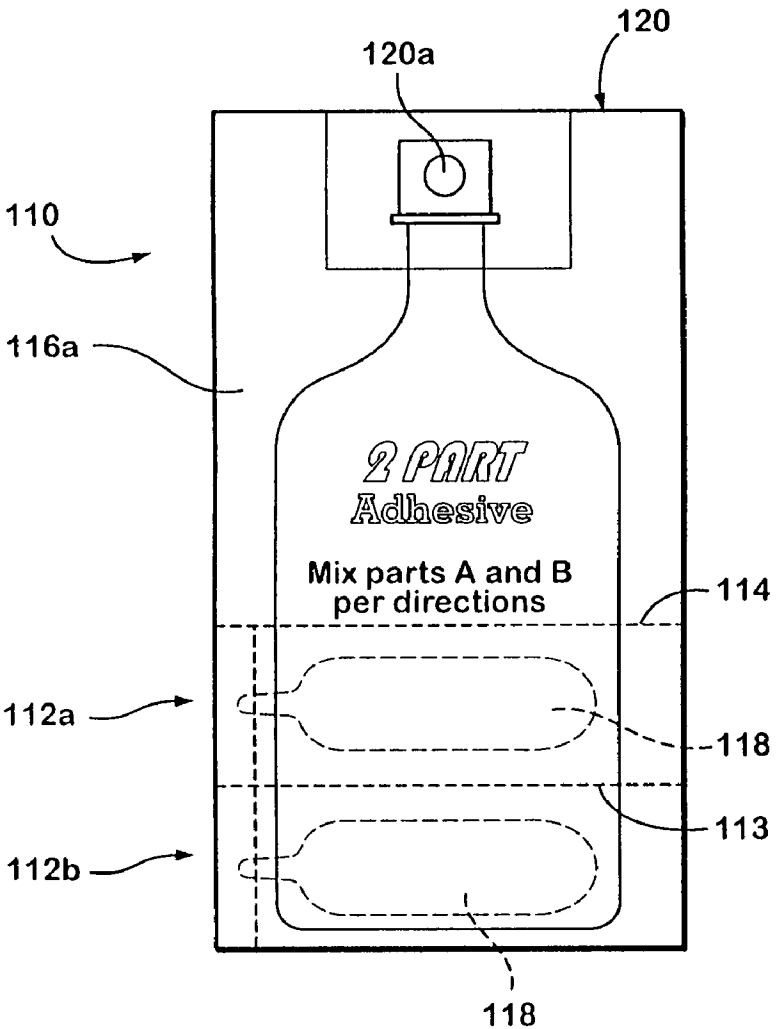
FIG. 4 is a plan view of a container for a two part adhesive in accordance with the present invention.

Optionally, and with reference to FIGS. 4 and 5, a compartmentalized adhesive container 110 includes and defines a pair of dispensers 112*a* and 112*b*, with each of the dispensers 112*a*, 112*b* having a cavity or pocket 118 for containing a small amount of adhesive therein, such as discussed above. Compartmentalized container 110 may contain two different adhesives such as for a two part adhesive or epoxy, where one dispenser may contain one part of the adhesive mixture and the other dispenser may contain the other part of the adhesive mixture. The adhesive materials may be dispensed from the dispensers and mixed together to make the adhesive mixture. After dispensing the adhesive portions and mixing the portions into the adhesive mixture, the dispensers may be discarded or thrown away, with minimal waste of adhesive.

Similar to compartmentalized container 10, the compartmentalized container 110 may comprise a pair of sheets or sheet portions 116*a* (FIG. 4) and 116*b* (FIG. 5) of printed flat stock or material, such as foil sheets or plastic or polymeric sheets or the like. The sheets 116*a*, 116*b* may comprise separate sheets sealed or joined or bonded together, or may comprise a single sheet folded over upon itself to form two adjacent sheets or sheet portions, without affecting the scope of the present invention. The sheets 116*a*, 116*b* may be selectively sealed or bonded or pressed or otherwise joined together to define compartmentalized container 110 and to define the two individual cavities 118 for containing the adhesive portions.

The cavity of each dispenser may be formed generally in the shape of a small typical adhesive dispenser or tube, and may have a narrowed tip portion or dispensing tip 118*a* for dispensing the adhesive portion from the dispenser. Optionally, the container may include a perforated or scored or otherwise marked or weakened line 115 along an end of the dispensing tips 118*a*, to facilitate tearing or cutting or ripping the tips 118*a* to open the single use dispensers for dispensing adhesive from the cavities. Optionally, and as shown in FIG. 5, each adhesive dispenser 112*a*, 112*b* may include an applicator portion 122, such as an applicator of the types described above.

Compartmentalized container 110 may also include a header portion 120, such as at an upper end of the compartmentalized container 110. As described above with respect to container 10, the header portion 120 of container 110 is integral with and an extension of the sealed or joined sheets or sheet portions 116*a*, 116*b*, and may provide an advertisement or other information about the product contained within the adhesive dispensers. The header portion 120 and adhesive dispensers 112*a*, 112*b* thus may be formed as part of a unitary sheet or container or packet, whereby the adhesive dispensers may be removed from the header portion for use (such as via tearing both dispensers 112*a*, 112*b* from the header portion 120 by tearing or cutting the sheets along a tear line 114). As shown in FIG. 5, the backside of the header portion may provide important information about the product or adhesive contained within the adhesive dispensers attached to the header portion. Preferably, the header portion 120 may include an opening therethrough 120*a* or a hook or the like formed thereon or attached thereto for hanging the compartmentalized container 110 on a hook or post or the like at a store.

When it is desired to use or mix the adhesive, the dispensers 112*a*, 112*b* may be folded along a fold line 113, such that their dispensing tips are 118*a* are generally aligned with one another. The dispensers may then be opened by tearing the tips open along tear line 115 (which may be perforated or weakened as described above). After the dispensers are opened, they may be squeezed together to simultaneously dispense their contents together, such that the adhesive portions may be readily mixed together where they are dispensed.

As shown in FIG. 4, the exterior or viewable side of one of the sheets may have an image or picture printed or screened or otherwise formed thereon. The image may be of a typical bottle or container of adhesive and may substantially cover the surface of the sheet of the compartmentalized container. Also, and as shown in FIG. 5, the exterior or viewable surfaces of the other sheet may include images of typical small adhesive tubes printed or embossed or screened or otherwise formed thereon, such that the cavities are positioned generally within the respective image or outline of a typical small adhesive tube. The image may include a body portion of the tube and a cap portion or the like and may be positioned to be generally over and aligned with the respective cavity and dispensing tip to provide visual aid to a user so the user can readily see where to cut or tear the dispensers to open the dispensers and dispense the adhesive portions from within the cavities.

Figure 7:
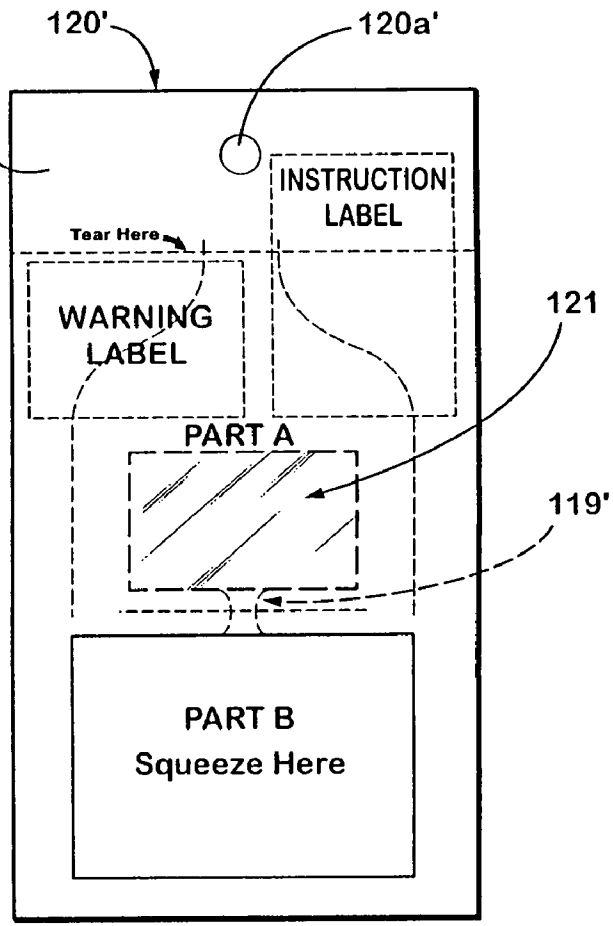
FIG. 7 is a plan view of the back side of the container of FIG. 6.
Figure 6:
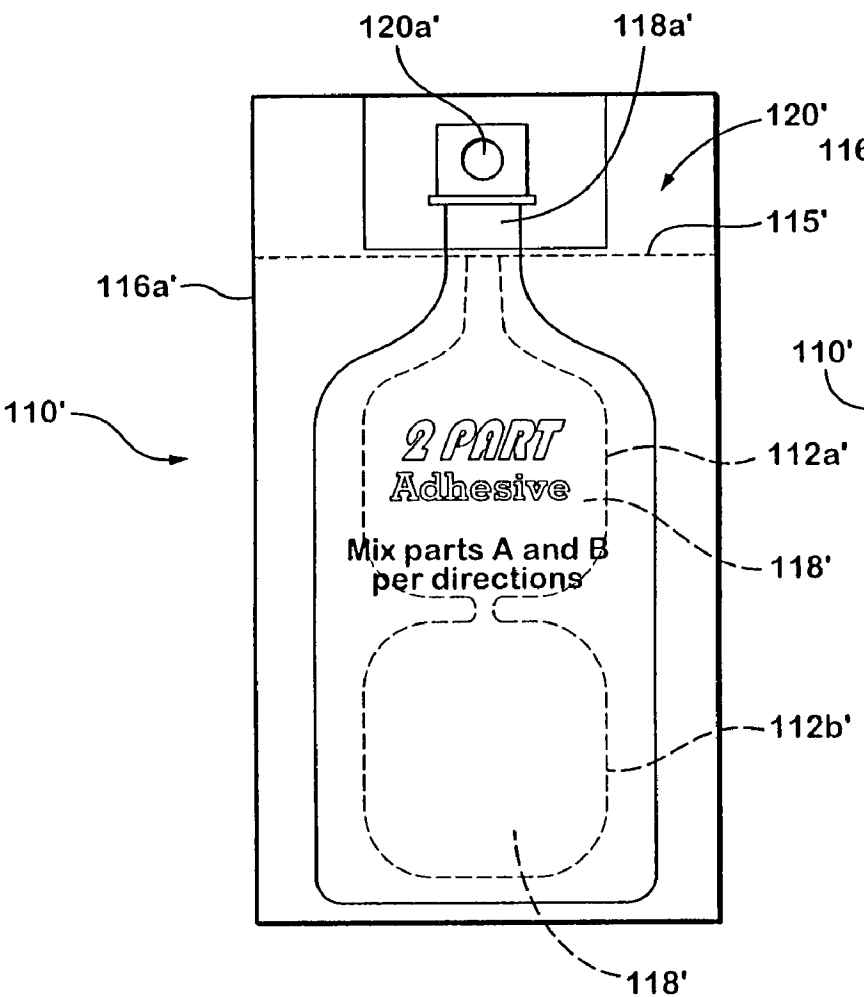
FIG. 6 is a plan view of another container for a two part adhesive in accordance with the present invention.

Optionally, and with reference to FIGS. 6 and 7, a compartmentalized adhesive container 110' includes and defines a pair of pouches 112*a*' and 112*b*', with each of the pouches 112*a*', 112*b*' having a cavity or pocket 118' for containing a small amount of a mixable adhesive portion therein, such as discussed above. Compartmentalized container 110' may contain two different adhesives such as for a two part adhesive or epoxy, where one dispenser may contain one part of the adhesive mixture and the other dispenser may contain the other part of the adhesive mixture. The adhesive materials may be mixed within one or both of the dispensers to make the adhesive mixture and may then be dispensed from the container. After dispensing the adhesive portions and mixing the portions into the adhesive mixture, the container may be discarded or thrown away, with minimal waste of adhesive.

Similar to compartmentalized containers 10, 110, the compartmentalized container 110' may comprise a pair of sheets or sheet portions 116*a*' (FIG. 6) and 116*b*' (FIG. 7) of printed flat stock or material, such as foil sheets or plastic or polymeric sheets or the like. The cavities of the pouches may be separated by a frangible sealed portion 119' positioned or formed generally between the pouches 112*a*', 112*b*'. The cavity 118' of one of the pouches 112*a*' may include a dispensing tip or nozzle 118*a*', such as at the header portion 120', for dispensing the mixed adhesive portion from the dispenser. Optionally, the container may include a perforated or scored or otherwise marked or weakened line 115' along an end of the dispensing tip 118*a*', to facilitate tearing or cutting or ripping the tip 118*a*' to open the pouch 112*a*' for dispensing the mixed adhesive from the cavities.

As described above with respect to containers 10, 110, the header portion 120' of container 110' is integral with and an extension of the sealed or joined sheets or sheet portions 116*a*', 116*b*', and may provide an advertisement or other information about the product contained within the adhesive dispensers. Preferably, the header portion 120' may include an opening therethrough 120*a*' or a hook or the like formed thereon or attached thereto for hanging the compartmentalized container 110' on a hook or post or the like at a store.

When it is desired to use or mix the adhesive, the pouch 112*b*' may be squeezed to cause the respective adhesive portion within the cavity of pouch 112*b*' to break the frangible seal 119' and to flow into pouch 112*a*' (which may be oversized to allow room for the additional adhesive portion to flow therein). The adhesive portions may then be readily mixed together (such as by repeatedly squeezing the container) within one or both of the cavities until the mixture is sufficiently mixed and ready for application. The pouch 112*a*' may then be opened by tearing the header portion 120' along the tear line 115' (which may be perforated or weakened as described above). After the dispenser is opened, the container may be squeezed to dispense its mixed contents, with no further stirring or mixing required. The container of the present invention thus provides an internal mixing container for mixing different adhesive portions, whereby the mixture may be dispensed onto the desired object with no further mixing being required.

As shown in FIG. 6, the exterior or viewable side of one of the sheets 116*a*' may have an image or picture printed or screened or otherwise formed thereon. The image may be of a typical bottle or container of adhesive and may substantially cover the surface of the sheet of the compartmentalized container. In the illustrated embodiment, the image includes a body portion and a cap portion, with the cap portion being positioned generally over and aligned with the dispensing tip 118*a*' and generally at the header portion 120'. Accordingly, when the cap portion is removed (such as via tearing along the tear line 115'), the dispensing tip 118*a*' is opened and the mixed adhesive may be dispensed from the adhesive. Also, and as shown in FIG. 7, the exterior or viewable surfaces of the other sheet 116*b*' may include a corresponding image of the other side of a typical bottle or container of adhesive. Optionally, a transparent or semi-transparent panel or window 121 may be provided in one or both of the sheets 116*a*', 116*b*' to allow a user to view the mixture through the window so that the user can identify when the mixture is properly or sufficiently mixed together. In such an application, it is desirable that the two adhesive portions be a different color or tint from one another to enhance the discernibility of one portion relative to the other and relative to the mixture.

Although shown and described as providing a compartmentalized container for containing quick drying adhesives and/or other types of adhesives and the like, it is further envisioned that the integral or unitary compartmentalized container and header portion of the present invention may be equally suitable for containing separate pockets of other flowable materials. For example, the pockets or cavities may contain a flowable material such as other types of adhesives, paints, air freshener fluid, grease, or any other flowable material that may be injected into the pockets or cavities and sealed therein, and dispensed from an opening formed in the individual separable dispenser. The flat stock sheets or sheet portions may be selectively sealed, as described above, to define the separate cavities or pockets for receiving the flowable material, and to define the header portion adjacent to one of the cavities. The flat stock sheets or sheet portions may be printed or may include graphics that outline or define the dispensers and the separation lines, and that further provide product information, UPC code, warning labels (if applicable), instructions and/or the like at the header portion of the integral container. The header portion may also include a means for hanging the container formed or defined thereon. The container of the present invention thus may provide multiple dispensers or packets that contain a flowable material and that are integrally formed with a header portion for hanging the container and/or for providing product information and the like about the flowable material contained within the dispensers.

Figure 8:
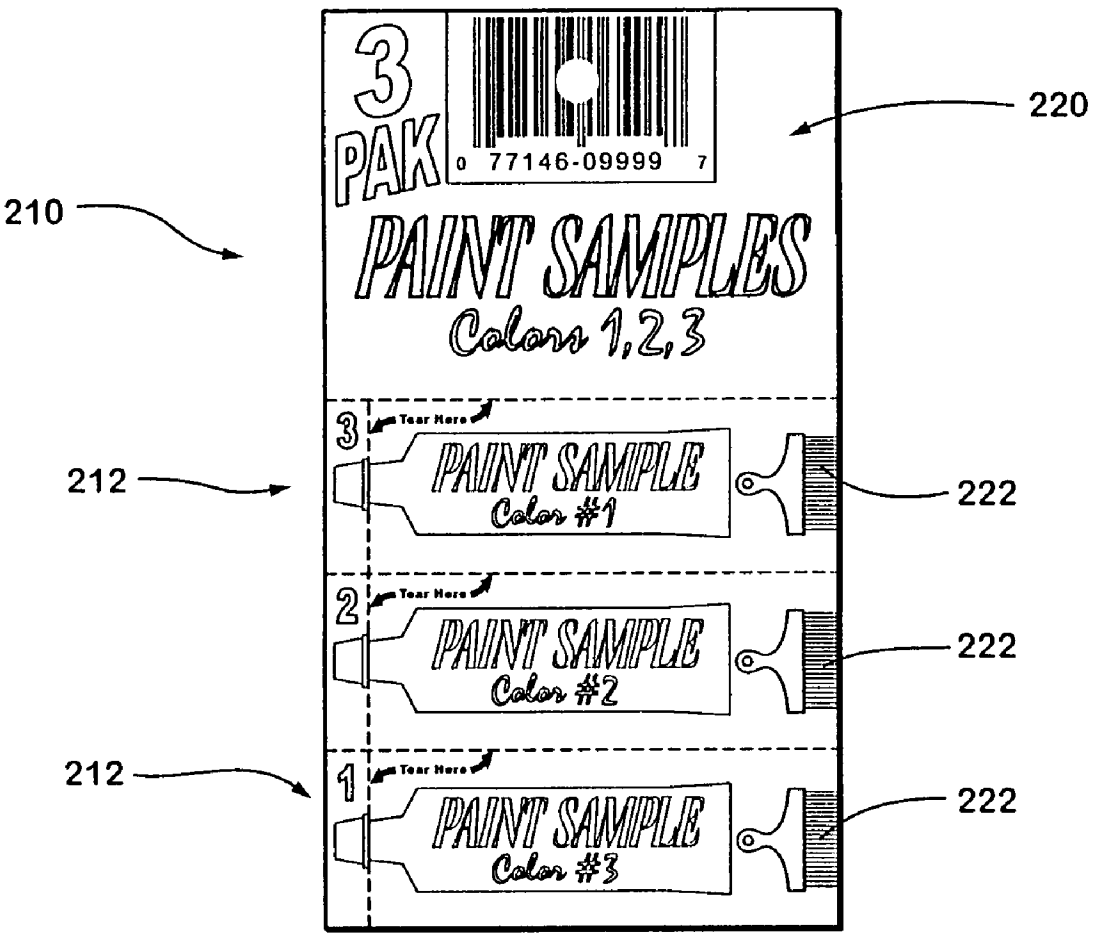
FIG. 8 is a plan view of a container that includes multiple single use dispensers holding different products.

The flowable material may be injected into the pockets such that each of the pockets contains the appropriate or desired flowable material. Optionally, a different flowable material may be injected into each of the pockets of an integral container (which includes multiple pockets/dispenser and the header portion). For example, and with reference to FIG. 8, a container 210 may include multiple pockets or dispensers 212, with different color paints injected into the pockets so that the integral container provides different color paint samples in a single container with a header portion 220. The dispenser containing the desired paint color may then be separated from the integral container by a user or consumer and opened (such as via tearing or cutting along an opening line or the like, such as discussed above), whereby the desired paint may be dispensed therefrom. The different color paints may be different tints or hues that are close on the color chart (such as different hues or shades of a particular green or the like) or may be contrasting colors that go well together to give examples of different wall and trim colors for a person to try at home, or may be any other combination of colors that may desirably be purchased or used together, without affecting the scope of the present invention.

The dispensers 212 may include an applicator 222 at an end thereof (or elsewhere on the dispenser such as discussed above) for spreading the paint sample on a surface after it has been dispensed from the particular dispenser. The applicator 222 may be printed on or applied to or formed on the dispenser, and may be in the form of a paint brush or the like, without affecting the scope of the present invention. The dispensers 212 and container 210 may be otherwise substantially similar to the dispensers and containers discussed above, such that a detailed discussion of the dispensers and containers will not be repeated herein.

Also, other types or categories of flowable materials may be injected or otherwise provided in the pockets, such as related materials or products that are often used in particular circumstances or situations, without affecting the scope of the present invention. For example, a condiment container may include a pocket filled with mayonnaise, a pocket filled with ketchup, a pocket filled with mustard and a pocket filled with relish and/or the like, all integrally formed with a condiment header portion; or a home kit may include a pocket filled with an adhesive, a pocket filled with an oil or lubricant, and a pocket filled with grease and/or the like, all integrally formed with a home kit header portion; or an outdoor or camping kit may include a pocket filled with insect repellant, a pocket filled with suntan lotion, and a pocket filled with moisturizer and/or the like, all integrally formed with an outdoor or camping header portion; or a travel kit may include a pocket filled with shaving cream, a pocket filled with after shave and a pocket filled with toothpaste and/or the like, all integrally formed with a travel kit header portion; or an air freshener set with different scented air freshening pouches and/or the like, all integrally formed with an air freshener set header portion. Any other groups or categories of flowable materials or products may be provided in respective pockets or groups of pockets that may be integrally formed with the header portion, without affecting the scope of the present invention. The header portion then may provide a title or label for the kit, and may provide a description of the products or flowable materials contained within the attached or integrally formed pockets or dispensers.

The integral dispensers and header portion thus may provide small packets of different materials for use by a consumer. The selected materials may be different for each dispenser of the integral container, but may be related or typically used together or typically used during a single project or activity, such as different color paint samples or the like, such as discussed above. Because the dispensers are single use dispensers, the pockets contain generally a small amount of flowable material therein, such that the dispenser may be discarded or thrown away after a single application or use of the flowable material. Optionally, the dispensers may include graphics or may be formed to define an applicator or spreader, such as described above, if such an applicator or spreader is appropriate or desirable to use in connection with the flowable material (such as, for example, paint or the like, where the graphics may show an image of a paint brush or the like) contained within the dispenser.

Figure 10:
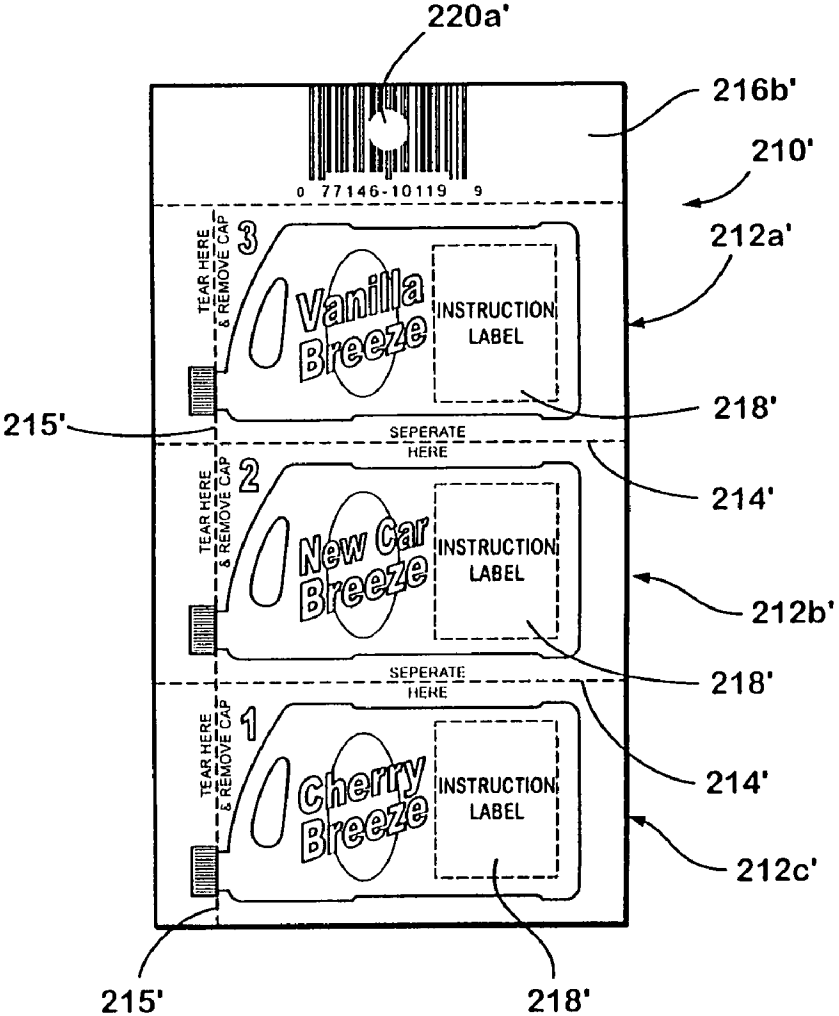
FIG. 10 is a plan view of the back side of the container of FIG. 9.
Figure 9:
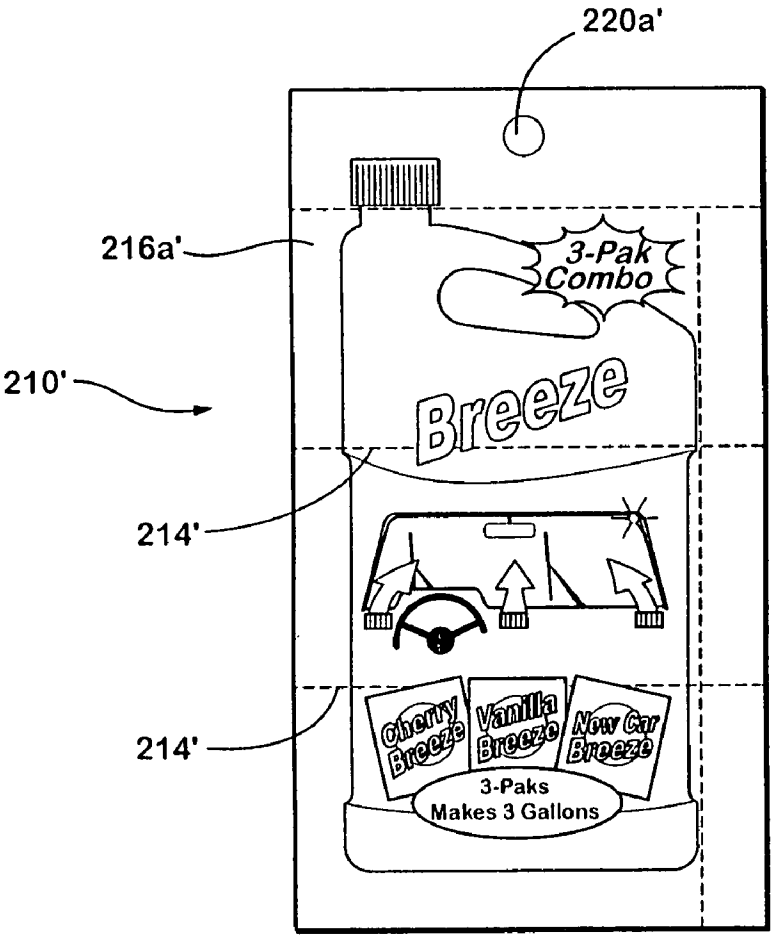
FIG. 9 is a plan view of another container that includes multiple single use dispensers holding different products.

Optionally, and as shown in FIGS. 9 and 10, a container 210' may include multiple pouches or dispensers 212*a*', 212*b*', 212*c*', each of which contains a scented flowable material or liquid therein. In the illustrated embodiment, each dispenser contains a different scent of the flowable material, so that a consumer may select which scent they want to use at a particular time. The scented fluid may be for an air freshener or the like, or may be added to the windshield wiper fluid of a vehicle to freshen or change the scent or odor in the vehicle cabin. Similar to the containers described above, the container 210' may comprise opposite sheet portions 216*a*', 216*b*' that are selectively sealed together to define multiple cavities 218' and the header portion 220'. The header portion 220' may also include an aperture 220*a*' or other hanging means for hanging and displaying the container at a store or the like.

As shown in FIGS. 9 and 10, the front sheet 216*a*' may include an image of a typical bottle or container printed or embossed or screened thereon, while the back sheet 216*b*' may include smaller images of bottles or containers positioned generally over and aligned with the cavities 218' of the dispensers 212*a*', 212*b*', 212*c*'. The front of the container thus gives the appearance of a single bottle of air freshener, while the rear of the container illustrates which dispenser has which scented material for use. When a particular scent is desired, the particular dispenser may be removed from the header portion and/or the other dispensers by tearing along one or more tear lines 214' to detach the dispenser from the container. The dispenser may then be opened via tearing along another tear line 215', such that the dispenser is opened and its contents may be discharged therefrom.

Figure 12:
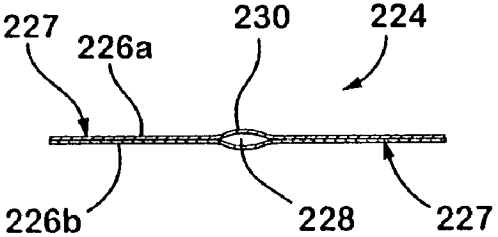
FIG. 12 is a sectional view of the pouch of FIG. 11 taken along the line XII—XII.
Figure 13:
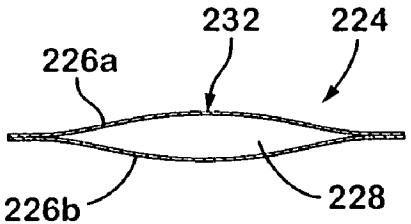
FIG. 13 is a sectional view of the pouch of FIG. 11 taken along the line XIII—XIII.
Figure 14:
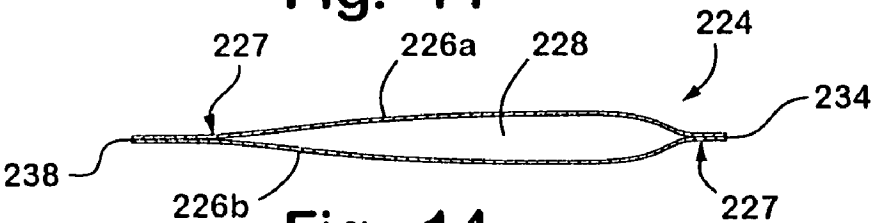
FIG. 14 is a sectional view of the pouch of FIG. 11 taken along the line XIV—XIV.
Figure 16:
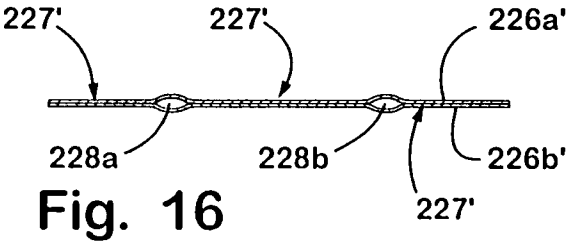
FIG. 16 is a sectional view of the pouch of FIG. 15 taken along the line XVI—XVI.
Figure 17:
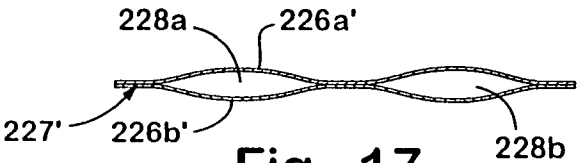
FIG. 17 is a sectional view of the pouch of FIG. 15 taken along the line XVII—XVII.
Figure 18:
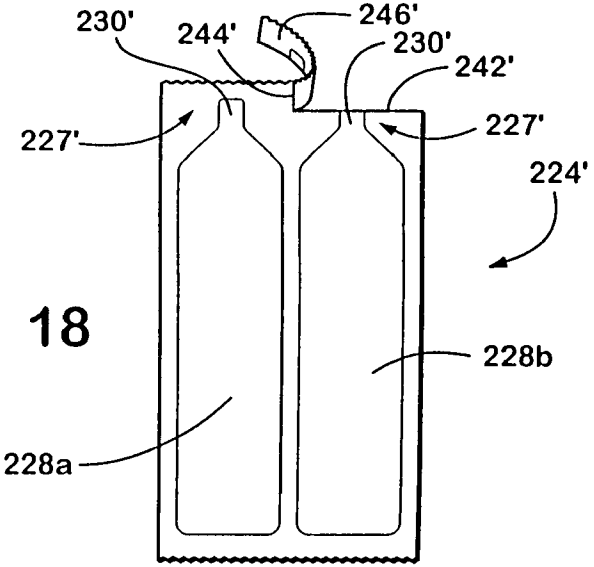
FIG. 18 is a plan view of the pouch of FIG. 15 illustrated with a section of the sheet material partially removed.

Referring now to FIGS. 11–14, a pouch 224 according to the present invention may comprise a cavity 228 that contains a small amount of a flowable material or product therein. The cavity 228 is formed in the shape of a bottle or the like of the type that typically holds larger quantities of the product, such that the pouch 224 and cavity 228 are representative of a miniaturized container of the product. Pouch 228 is made up of a first sheet 226*a* and a second sheet 226*b* (FIGS. 12–14). Each of the sheets 226*a*, 226*b* are secured together about a peripheral area 227. Peripheral area 227 generally extends around the periphery of first and second sheets 226*a*, 226*b*. A cavity 228 is defined between first and second sheets 226*a*, 226*b* in a location surrounded by peripheral area 227. First and second sheets 226*a*, 226*b* are not secured together in the regions where cavity 228 is defined. Cavity 228 is adapted to store a desired amount of flowable material, such as a liquid. While other materials may be stored using pouch 224 within the scope of the present invention, the invention finds particular application to using pouch 224 to store flowable materials that are used in association with automobiles, such as brake fluid, battery corrosion cleaners, gas and transmission additives, radiator hose grease and other greases, spark plug boot protectors, brake lubricants, battery terminal protectors, rust looseners, and anti-seize compounds, as well as still other types of flowable materials.

Cavity 228 is completely surrounded by peripheral area 227 when pouch 224 is not opened. The flowable material stored inside cavity 228 is therefore completely enclosed and cut off from the ambient surroundings of pouch 224. First and second sheets 226*a*, 226*b* are preferably made of a material that allows cavity 228 to be hermetically sealed. While any suitable flexible material may be used to construct sheets 226*a*, 226*b*, plastic or foil type material that is conventionally used in condiment packets, such as ketchup or mustard may be used. The construction of pouch 224 and the filling of cavity 228 with flowable material may be carried out in the same or similar manner as the construction and filling of such condiment packets. When it is desired to gain access to the contents of cavity 228, first and second sheets 226*a*, 226*b* are torn or cut along a score line 236. Score line 236 intersects a neck portion 230. Once the score line 236 is severed through neck 230, the contents of pouch 224 can either be poured out by tipping pouch 224, or expelled out by squeezing the sheets 226*a*, 226*b* around cavity 228. As will be described in more detail below, a picture of a container having a cap may be graphically printed on one or both of sheet portions 226*a*, 226*b*. Score lines 236 may be positioned to intersect the printed cap to convey the visual image that severing the pouch along score line 236 is tantamount to removing a real cap from a real one of the pictured containers.

Figure 11:
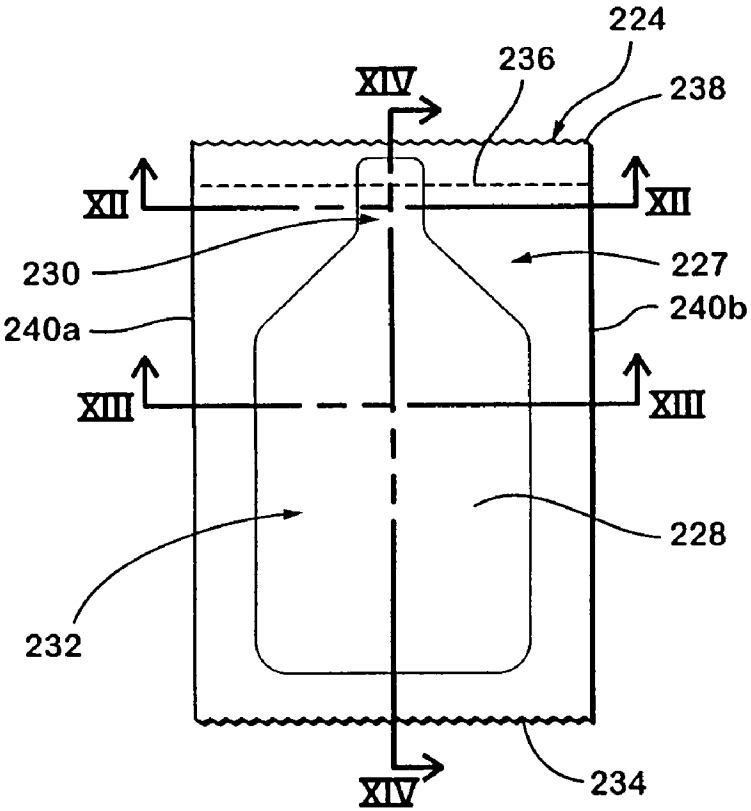
FIG. 11 is a plan view of a pouch according to one aspect of the present invention.

In the illustrated embodiment of FIG. 11, cavity 228 includes a neck or spout portion 230 and a body portion 232. Neck portion 230 is substantially narrower than body portion 232 and is positioned adjacent an end of the pouch 224. As mentioned above, the contents of cavity 228 are preferably accessed by tearing first and second sheets 226*a*, 226*b* so that the tear or cut intersects neck portion 230 of cavity 228. By severing pouch 224 through neck portion 230, an open passageway is created that has the width of neck portion 230. Construction of neck portion 230 thus allows the user access the pouches contents through a predefined, standard sized orifice that is created when the pouch is torn. This contrasts to conventional condiment pouches which easily allow different size openings to be created by tearing the packet in different locations. In many instances, the non-uniform size of the orifice is undesirable because it may either be too small to expel the contents quickly enough, or may be too large, thereby allowing the contents to prematurely leak out. In the latter case, the contents may easily dribble over portions of the pouch and onto the user's fingers, and cause other undesirable effects.

Figure 23:
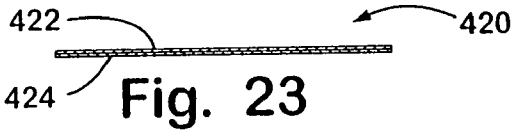
FIG. 23 is a sectional view of the pouch of FIG. 22 taken along the line XXIII—XXIII.
Figure 24:
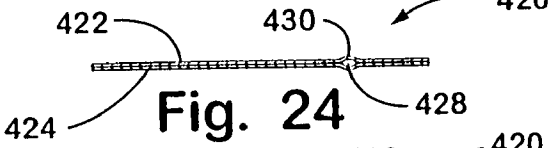
FIG. 24 is a sectional view of the pouch of FIG. 22 taken along the line XXIV—XXIV.
Figure 25:
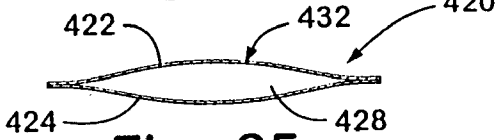
FIG. 25 is a sectional view of the pouch of FIG. 22 taken along the line XXV—XXV.

While the neck portion 230 of cavity 228 is depicted in FIG. 11 as being generally centered near the top of pouch 224, it will be understood that the shape of cavity 228 can be varied substantially from that illustrated. For example, neck portion 230 could be positioned in an off center location, such as is illustrated in the pouch embodiment of FIG. 23. Alternatively, multiple neck portions could be defined, such as having one defined near each of the upper corners of pouch 224. Further, the shape of neck portion 230 with respect to body portion 232 can be varied substantially. As illustrated, body portion 232 is generally rectangular with a straight, tapered section leading to neck portion 230. Body portion 230 could be defined without the tapered section, or could be shaped in other manners.

While pouch 224 is illustrated in the accompanying drawings as being made of two separate sheets 226*a*, 226*b*, it will be understood that sheets 226*a*, 226*b* could be constructed from a single sheet of material that is folded over on itself. For example, a single sheet of material could be folded along a line that defines the bottom edge 234 of pouch 224. The fold would therefore define bottom edge 234. The two sheets would then be secured together about the rest of peripheral area 227 outside of the fold. The securing of the two sheets together can be accomplished in any conventional manner, such as through the use of heat sealing or adhesives. Other methods of securing the sheets together are also possible, and the present invention contemplates using the same sealing methods as those used to secured the sheets of conventional condiment packets together.

As noted above, a score line 236 may also be included on pouch 224, such as near an upper end or top edge 238 of container or pouch 224. As illustrated in FIG. 11, score line 236 is generally straight and extends across pouch 224 from side 240*a* to 240*b*. Score line 236 intersects neck portion 230 of cavity 228. Score line 236 defines a line along which pouch 224 may desirably be severed to gain access to the contents of cavity 228. The score line 236 may simply comprise a printed line that provides a visual indication for where the pouch should be severed. Alternatively, score line 236 may comprise a structurally weakened line defined in first and second sheets 226*a*, 226*b* that tends to cause first and second sheets 226*a*, 226*b* to tear along this line. For those sections of score line 236 which are defined in peripheral area 227, the structural weakening may comprise perforations in first and second sheets 226*a*, 226*b*. Alternative methods for defining structurally weakened areas are also known in the art, and any of these methods may be used within the scope of the present invention. The shape of score line 236 may also be varied substantially from that of FIG. 11.

Figure 15:
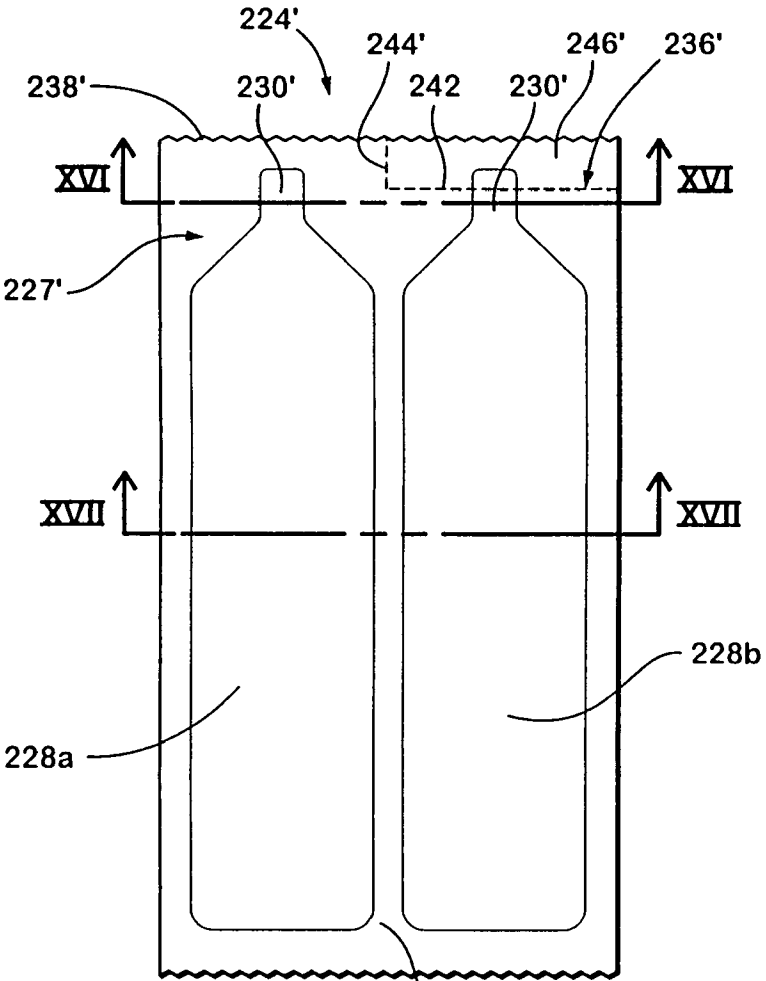
FIG. 15 is a plan view of a pouch according to another embodiment to the present invention.

Another pouch 224' according to a second embodiment of the present invention is depicted in FIGS. 15–18. Pouch 224' is constructed of two sheets 226*a'*, 226*b'* in the same manner as pouch 224 with the exception that pouch 224' includes a peripheral area 227' that defines two cavities 228*a* and 228*b* rather than a single cavity. Each cavity 228*a* and 228*b* includes a neck portion 230' and a body portion 232'. Cavities 228*a* and 228*b* are defined in separate areas of pouch 224' and are each physically and hermetically isolated from each other, as well as the ambient air outside pouch 224'. Pouch 224' may be used to store any desirable flowable material, but is particularly well suited for storing two quantities of brake fluid. Pouch 224' may include a score line 236' for each neck portion 230' of each cavity 228*a* and 228*b*. Score line 236' of FIG. 15 is defined to include a horizontal section 242' and a vertical section 244'. Horizontal section 242' extends through and intersects neck portion 230' of cavity 228*b*. Vertical section 244' connects horizontal section 242' with top edge 238'. When score line 236' of pouch 224' is torn, a tear-away section 246' is torn off along score lines 236' (see FIG. 18). Vertical section 244' is defined to ensure that the tearing off of section 246' can be accomplished to open one cavity without accessing the contents of the other cavity. In other words, score lines 236' are preferably configured so that either of cavities 228*a* and 228*b* can separately be accessed without accessing the contents of the other cavity. This allows the user of pouch 224' to use the contents of one cavity and then place the pouch 224' into storage for an extended period of time while still retaining the contents of the unopened cavity in a hermetically sealed, isolated container.

While horizontal section 242' of score line 236' is depicted in FIG. 15 as extending only halfway across pouch 224', it will be understood that horizontal section 242' could be modified to extend all the way across pouch 224' such that it intersects neck portions 230' of both cavities 228*a* and 228*b*. As still another alternative, score lines 236' could be curved. If score lines 236' are merely visual lines, rather than structural weaknesses, it may be desirable to print score line 236' on only one side of pouch 224' for a given cavity. Thus, cavity 228*a* would have its score line printed on one side of pouch 224' and cavity 228*b* would have its score line 236' printed on the opposite side of pouch 224'. This arrangement would provide a visual reinforcement that each of the cavities 228*a* and 228*b* can be separately accessed.

Figure 19:
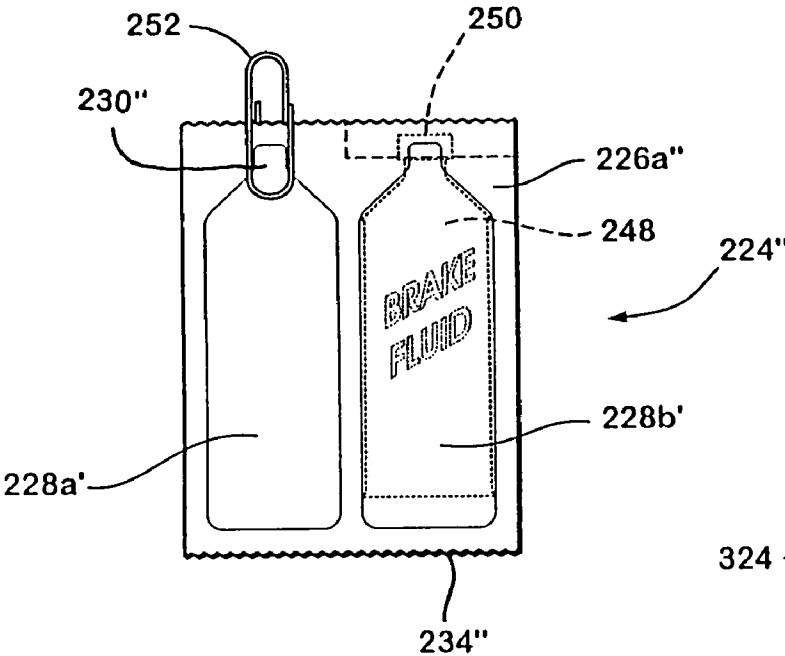
FIG. 19 is a plan view of a pouch according to another embodiment of the present invention.

FIG. 19 illustrates another embodiment of a pouch 224" according to the present invention. Pouch 224" may be identical to pouch 224' with the exception that a picture 248 is printed on the exterior side of at least one of the sheets 226*a*". The picture 248 is preferably of a container that is otherwise used to store the type of fluid contained in pouch 224". For example, if the cavities 228*a'*, 228*b'* are filled with brake fluid, picture 248 may be a picture of a conventional brake fluid container, such as a can or bottle. Alternatively, if pouch 224" contains shampoo, shaving cream, or toothpaste, a shampoo bottle, a shaving cream can, or a toothpaste tube, respectively, can be depicted. Still other pictures would be used for storing other flowable materials. While picture 248 is depicted in FIG. 19 in dashed lines, it will be understood that this is merely to differentiate the boundaries of picture 248 from the boundaries of cavity 228*b'*. Picture 248 preferably is in color and detailed enough to convey a realistic image of the container it represents.

Picture 248 includes a cap 250 that is illustrated as being positioned on top of the container. The phrase "brake fluid" is shown printed on first sheet 226*a*" as part of picture 248. This is an optional part of the picture and would of course be modified if other materials were stored in pouch 224". It will be understood that picture 248 can take on any size, shape, color, or artistic embodiment that depicts a container. Preferably, although not necessarily, the picture 248 will include the depiction of a container having a neck portion which is aligned with the neck portion 230" of the underlying cavity. By maintaining this alignment, the contents of the cavity will exit out of the cavity through an orifice that is aligned with the picture 248 printed on pouch 224". This alignment provides a visual indicator to the user of the pouch as to where the contents will exit the pouch, thereby facilitating the application of the contents. The rest of picture 248 may or may not have its boundaries aligned with the boundaries of the underlying cavity. At least one embodiment of the present invention contemplates having all of the boundaries of the pictured container aligned with the boundaries of the underlying cavity. Preferably, although not necessarily, the picture 248 for cavity 228*b*' may be printed on the exterior side of first sheet 226*a*" (as shown in FIG. 19), while the picture 248 for cavity 228*a*' is printed on the external side of the second or opposite sheet (not shown in FIG. 19). Each cavity therefore has its own picture 248, and each picture is printed on opposite sides of pouch 224". By printing the two pictures 248 on opposite sides of the pouch 224", further visual reinforcement is provided that the two cavities can be accessed separately.

Both pouch 224' depicted in FIG. 15 and pouch 224" depicted in FIG. 19 have two cavities. The purpose of having two or more cavities in a single pouch is to facilitate the expelling of the contents of the cavities. Specifically, when the first of the cavities is to be opened, a person can securely grab hold of the other half of the pouch that contains the cavity which is not being opened. By holding onto this half of the pouch, the squeezing of the pouch between the user's fingers has no effect upon the pressure of the fluid contained within the other cavity. Thus, when a portion of the pouch is torn off to gain access to the contents of that cavity, the user's fingers do not exert any pressure against the walls of that cavity. After the first cavity is emptied of it contents, the user can then grab hold of the pouch in the area defined by the empty cavity when tearing open the other cavity. Grabbing the pouch in this depleted area again provides a handle by which the user can squeeze the pouch without putting pressure on the contents of the full cavity. The user of two separate pouches thus minimizes the potential problem of having the contents of the pouch squirt out when the pouch is opened due to the pressure exerted by the user's fingers in maintaining a grip on the pouch. Tearing off a portion of the pouch can therefore be accomplished without any leakage of the fluid. For embodiments having only one cavity, such as pouch 224, the peripheral area 227 around neck portion 230 may provide a sufficiently large gripping area for a person to squeeze the pouch without expelling any of the contents of the cavity 228. For these embodiments, a picture of the tip of a finger or a thumb can be provided at a location where a user can place his or her thumb or finger in order to securely grip the pouch while tearing it open. Alternatively, a graphic depiction of a handle, such as on a tea cup or the like, can be provided to serve as a visual guide. This is described in more detail below.

Optionally, a paper clip 252 may be provided with the pouch 224" depicted in FIG. 19. Paper clip 252 can be provided as part of any of the different pouch embodiments described herein. Paper clip 252 provides two separate functions. First, paper clip 252 can be used as a squeegee to expel the contents out of the cavity after it has been opened. This can be accomplished by attaching the paper clip 252 in a manner such as illustrated FIG. 19 in which one prong of the paper clip is positioned on one side of the pouch and another prong is positioned on the opposite side of the pouch. If the paper clip is initially positioned near the bottom edge 234", the pouch can then be slid upwardly toward the neck portion 230 of the cavity. The natural pressure of the paper clip will tend to push the first and second sheets together, thereby pushing the fluid down from the neck of the cavity as clip 252 is moved and into the larger chamber portion. The clip thus may act like a squeegee to force the residual contents in the neck back into the cavity. If paper clip 252 is not physically provided as part of pouch 224", directions for using the paper clip may be printed on pouch 224" as an alternative.

The second use for paper clip 252 is to use it as a closure device. After a cavity has been opened and only a portion of the contents expelled, paper clip 252 can be clipped over the pouch to seal the exit orifice. Paper clip 252 will thus tend to prevent leakage of the remaining contents of the cavity, as well as to provide a relatively tight seal to the cavity. Paper clip 252 may be provided with the pouch by being adhesively secured thereto, or it may be secured thereto by being clipped onto the pouch in a manner like that illustrated in FIG. 19. Other attachment manners are also possible.

Figure 21:
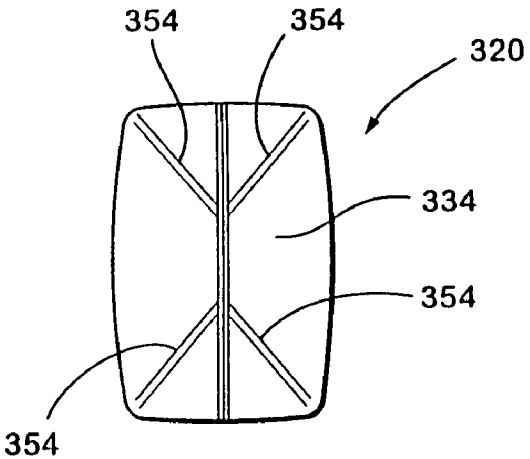
FIG. 21 is a bottom view of the pouch of FIG. 20.
Figure 20:
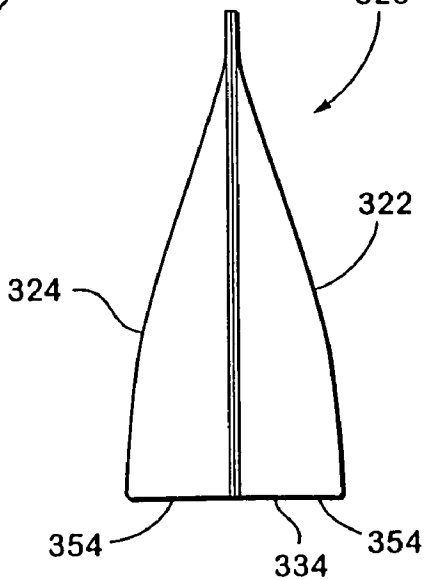
FIG. 20 is a side view of a pouch according to another embodiment of the present invention.

FIGS. 20 and 21 depict another pouch 320 according to the present invention. Pouch 320 may be constructed with a single cavity 328 or multiple cavities 328. Pouch 320 is different from the previously described pouches in that it includes a plurality of gussets 354 defined in first and second sheets 322 and 324 near bottom edge 334. Gussets 354 are generally rigid, or semi-rigid, structures that tend to give pouch 320 a flat bottom. Pouch 320 can therefore be stood up on a flat surface without tipping over. Pouch 320 may be constructed from first and second sheets 322 and 324 that are secured together in the same manner as the other pouch embodiments described herein. First and second sheets 320 and 322 are shaped to provide sufficient material for a flat bottom to be defined. Gussets 354 may be constructed in any conventional manner. For example, gussets 354 can be constructed of generally rigid or semi-rigid plastic material that is adhered to, or incorporated into, first and second sheets 322 and 324 at the appropriate locations. Preferably, although not necessarily, first and second sheets 322 and 324 may be defined from a single sheet of material that is folded over onto itself. The fold may preferably be located at the bottom edge 334 of pouch 320.

Figure 22:
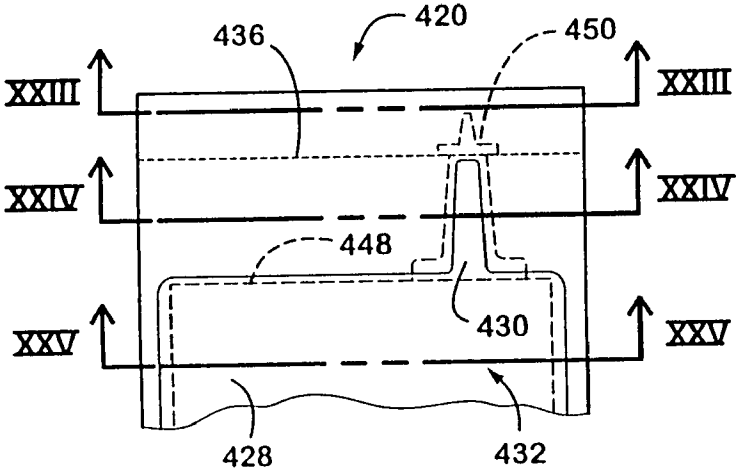
FIG. 22 is a partial, plan view of a pouch according to another embodiment of the present invention.

A pouch 420 according to another embodiment of the present invention is depicted in FIGS. 22–25. Pouch 420 differs from pouch 224 in three respects. First, pouch 420 includes a picture 448 of a container printed on either or both of sheets 422 and 424 similar to a can or bottle. Second, pouch 420 includes a cavity 428 that is shaped differently from that of pouch 224. Specifically, the neck portion 430 of pouch 420 is positioned off-center and the body portion 432 has a different shape. Third, a different shaped picture of a cap 450 is also included in pouch 420. As can be seen in FIG. 22, the cap is positioned generally at a score line 436, such that tearing the container or pouch along the score line removes the cap from the pictured container. Pouch 420 is otherwise constructed in the same manner as has been previously described with respect to pouch 224.

Figure 38:
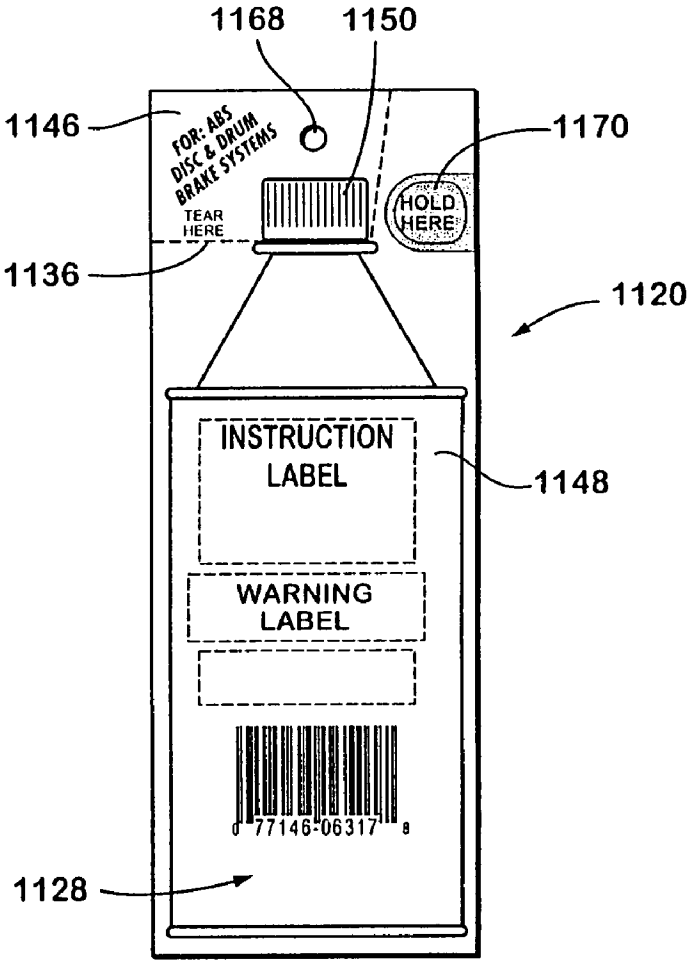
FIG. 38 is a plan view of the other side of the pouch of FIG. 37 illustrating graphics simulating the back side of the graphical brake fluid container.
Figure 37:
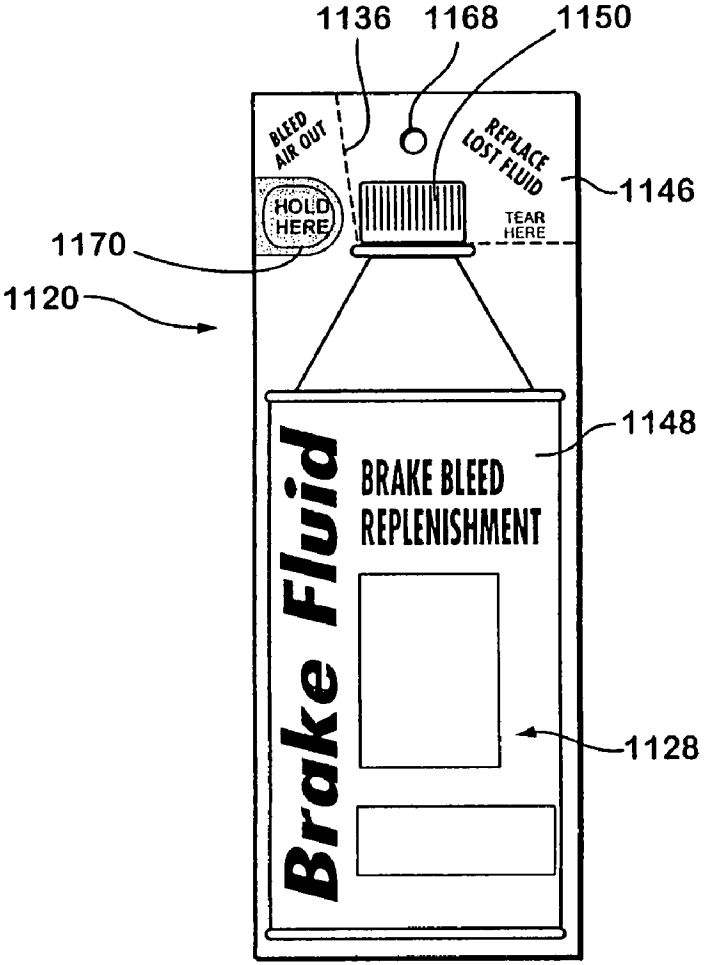
FIG. 37 is a plan view of a pouch according to another embodiment of the present invention incorporating graphics illustrating a simulated brake fluid container.

As with picture 248 of pouch 224", the picture 448 of pouch 420 is illustrated in dashed lines. This is purely for clarity of visually distinguishing between the borders of cavity 428 and picture 448. The borders of the container depicted in picture 448 may be substantially aligned with or on top of the underlying borders of the cavity 428. A picture 448 may be included on one or both of sheets 422 and 424. If a picture 448 is included on both sheets 422 and 424, the picture on one sheet may be of the front of a container and the picture on the other sheet may be of the back of the container. The visual image presented thus conveys a similarity between the pictured container and the pouch 420. This provides a visual appeal and facilitates the use of the pouch, particularly where the container picture includes a spout that aligns with the neck portion 430 of the cavity 428. An example of one type of picture that may be included is depicted in FIGS. 37 and 38, which illustrates the front and back sides of a pouch according to the present invention.

In addition to placing graphics on the pouch that depict a conventional container for the type of material being stored in the pouch, other types of graphics are also contemplated within the scope of the invention. If the pouch contains an oil, such as olive oil, a picture or image of an olive may be printed on the pouch. If the pouch contains another type of oil, the plant from which the oil is predominantly derived from may be depicted in the picture on the pouch. If the pouch contains a fragrance, a picture may be included of one of the main components of the fragrance. For example, if the fragrance is designed to produce an aroma of coconuts, the picture may be of a coconut. Similar depictions of items that are recognizably associated with the contents of the pouch may be depicted in the picture for other types of flowable materials. Regardless of what type of flowable material is being used and what corresponding picture is printed on the pouch, the picture or image is preferably positioned such that the score line intersects the picture. Thus, for example, if the picture depicts an olive, the visual image will be conveyed that the olive is being opened when the tear-away portion is torn off of the pouch. Ideally, only a small portion of the picture is torn away during the opening process. The edges of the picture at its intersection with the score line may preferably by substantially aligned with the edges of the neck portion of the underlying cavity so that the contents of the pouch will exit substantially where the picture was severed. The picture thus acts as a visual guide of not only what the contents of the pouch are, but also as to where the contents of the pouch will exit after the tear-away portion has been removed.

Figure 28:
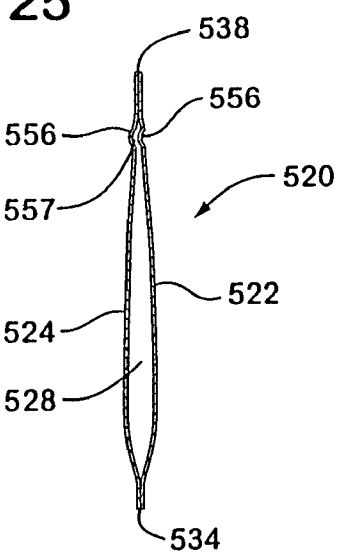
FIG. 28 is a sectional view of the pouch of FIG. 26 taken along the line XXVIII—XXVIII.
Figure 27:
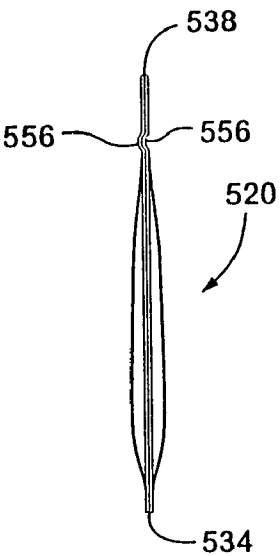
FIG. 27 is a side view of the pouch of FIG. 26.
Figure 26:
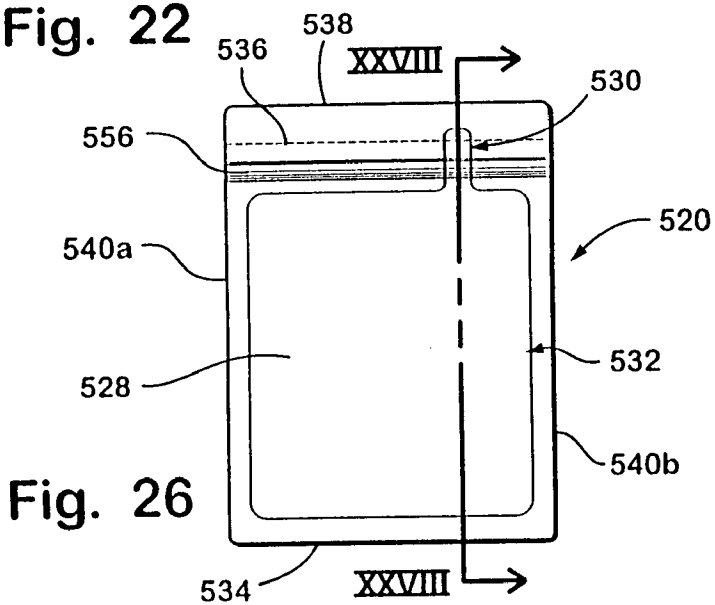
FIG. 26 is a plane view of a pouch according to another embodiment of the present invention.

As shown in FIGS. 26–28, a pouch 520 according to another aspect of the present invention includes a cavity 528 defined between two sheets 522 and 524. Cavity 528 may be used to store any desirable flowable material. Pouch 520 differs from the previously described pouches in that it includes a crease or bend 556 that extends across pouch 520 from side 540*a* to side 540*b* (FIG. 26). Crease 556 is illustrated in FIGS. 27 and 28 to have a generally semicircular shape. Crease 556 can take on a variety of other shapes within the scope of the present invention. Crease 556 functions as a self-sealing member that substantially prevents the escape of fluid out of cavity 528 after a tear has been made along score line 536. After a person has severed pouch 520 along score line 536, the contents of cavity 528 may generally not be expelled out of neck portion 530 of cavity 528 without the application of additional pressure to the sheets 522 and 524 that define cavity 528. This added pressure is necessary because of crease 556. Crease 556 tends to maintain first and second sheet portions 522 and 524 in contact with each other in neck portion 530. This contact is sufficient to prevent a fluid from escaping out of neck portion 530 without the application of additional pressure. This contact is also sufficient to prevent fluid from escaping or evaporating out of neck portion 530 when pouch 520 is turned upside down and only the force of gravity is exerted to move the fluid out through neck portion 530. When pressure is applied to cavity 528, this forces first and second sheets 522 and 524 to separate from each other in crease 556. Such a separation is illustrated in FIG. 28 and identified by reference numeral 557.

One method of expelling the contents of pouch 520 out of neck portion 530 is to squeeze the pouch 520 by rolling the body 532 of pouch 520 from its bottom edge 534 upwardly towards its top edge 538. This rolling decreases the volume of cavity 528 as it continues towards top edge 538. As the volume of cavity 528 decreases, its content are forced outward through neck portion 530. Because of the pressure involved and the size of outlet orifice in neck portion 530, the contents may be squirted out of pouch 520. By decreasing the size of the outlet orifice, it may be possible to cause the contents to exit neck portion 530 in an aerosol, or near-aerosol fashion. After the desired amount of flowable material has been expelled from cavity 528 of pouch 520, crease 556 causes the sheets 522 and 524 in neck portion 530 to return to a state of contact with each other, thus inhibiting any further outflow of fluid in the absence of applied pressure. Crease 556 thus acts as an automatic seal-sealing device that automatically cuts off the contact of the contents of cavity 528 with ambient air after the applied pressure is terminated. It also substantially prevents any leakage of the product after the applied pressure is terminated. Thus, if not all of the contents of cavity 528 are used in a given application, pouch 520 can be easily stored after its use without taking any additional steps to prevent leakage of the contents.

While other materials and dimensions may be used with pouch 520, the neck portion of cavity 528 may have a width of approximately three millimeters. The height of crease 556 (that is, its extent in the direction from bottom edge 534 toward top edge 538) may be about four millimeters. The amount of deflection of crease 556 from the plane defined by first and second sheets 522 and 524 when they are completely flat may be about one millimeter. As noted, the invention contemplates a wide variety of different dimensions for crease 556 and neck portion 530. Each of the sheets of pouch 520 may be made out of a layer of saran-coated polyester adhered to a layer of linear, low density polyethylene, although other materials may be used as well without affecting the scope of the present invention.

Figure 30:
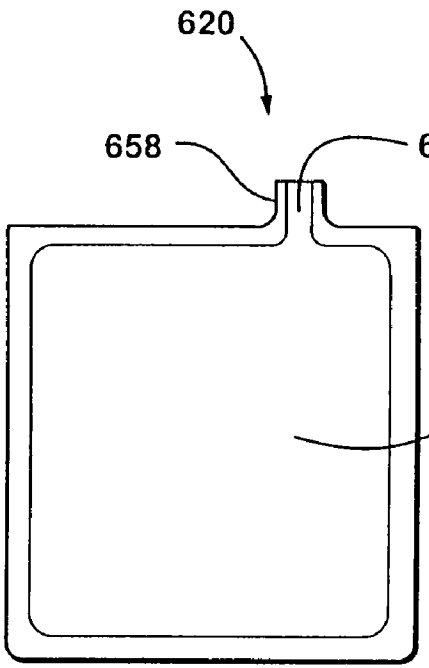
FIG. 30 is a plan view of the pouch of FIG. 29 illustrated after a section of the pouch has been torn away.
Figure 29:
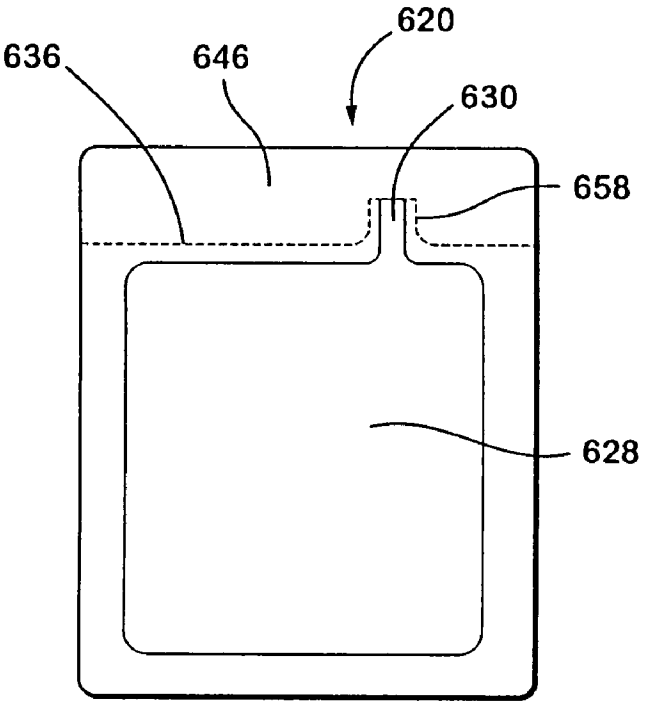
FIG. 29 is a plan view of a pouch according to another embodiment of the present invention illustrated before a section of the pouch has been torn off.

As shown in FIGS. 29 and 30, a pouch 620 according to another aspect of the present invention includes a cavity 628 defined between a pair of sheets that are sealed about their periphery. A neck portion 630 is defined as part of cavity 628. Pouch 620 differs from the other pouches heretofore described in that its score line 636 is shaped differently from the other score lines previously described. Score line 636 of pouch 620 is generally shaped to define a spout 658. That is, after a person has removed the tear-away section 646 of pouch 620 located above score line 636, the remaining top edge of the pouch 620 has a spout shape. Spout 658 is defined at the same location as neck portion 630. Spout 658 provides a readily apparent visual indication of where the contents of cavity 628 will exit after tear-away portion 646 has been torn away. The user of pouch 620 thus has better control over expelling the contents and can aim the spout 658 where the contents of cavity 628 are intended to be applied. Score line 636 of pouch 620 preferably is defined as a line of weakened material in at least one of the sheets that is adapted to tear more easily than the other parts of the sheets. Therefore, score line 636 will define the shape of the tear when tear-away portion 646 is torn away. Pouch 620 can be modified from that illustrated to include a picture of a container overlying cavity 628, to include a crease or the like, to include multiple cavities with multiple spouts, or to include any one or more of the features of the other pouches previously described herein.

Figure 31:
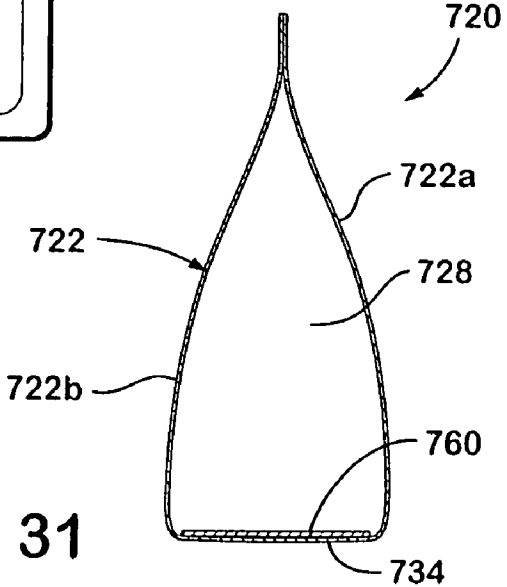
FIG. 31 is a side, sectional view of a pouch according to another embodiment of the present invention.

As shown in FIG. 31, a pouch 720 according to another aspect of the present invention includes a cavity 728 defined between sheet portions 722*a*, 722*b* of a sheet 722 that is folded over on itself at a bottom 734 and sealed together along its sides and top 738 to define opposite sheet portions 722*a*, 722*b*. Additionally, pouch 720 includes a relatively stiff base member 760 positioned at the bottom of cavity 728. Base member 760 expands the volume of cavity 728 and provides a generally flat bottom so that pouch 720 can be stood up by itself, if desired. Base member 760 can be made of any suitable material, and may be embedded, adhered, or otherwise affixed to the bottom 734 of pouch 720, if desired, in order to maintain is proper placement at the bottom of cavity 728.

Figure 33:
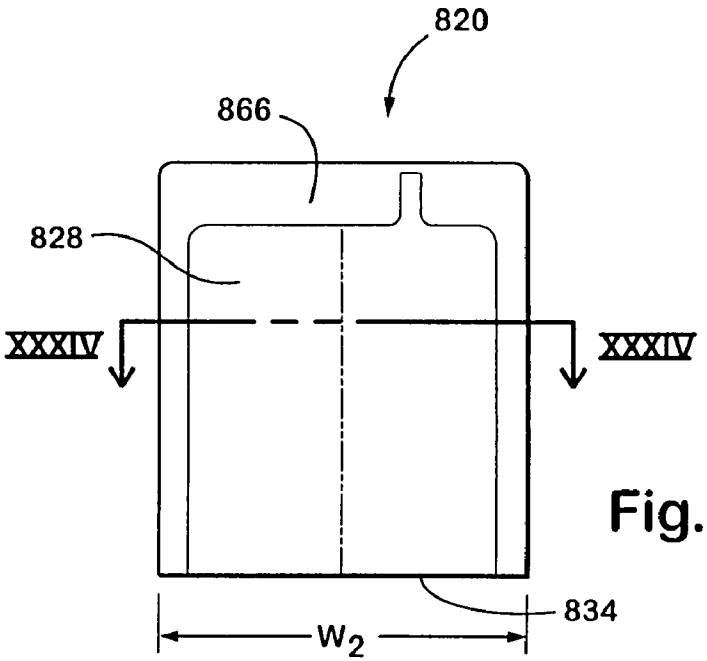
FIG. 33 is a plan view of a pouch according to another embodiment of the present invention incorporating the sheet portion of FIG. 32.
Figure 34:
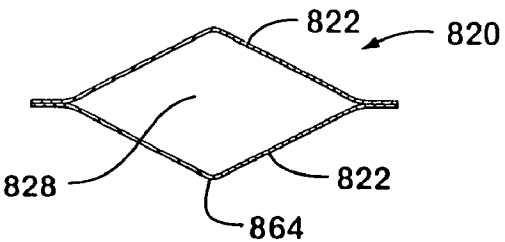
FIG. 34 is a sectional view of the pouch of FIG. 33 taken along the line XXXIV—XXXIV.
Figure 32:
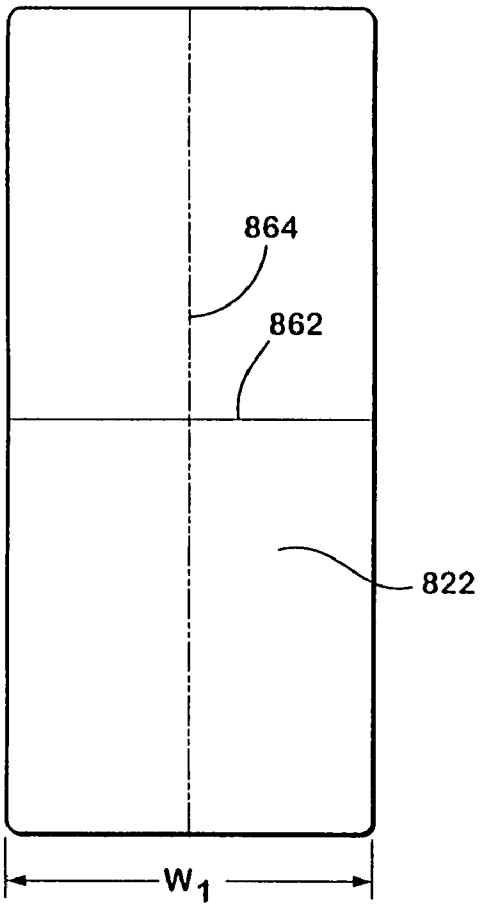
FIG. 32 is a plan view of a sheet portion illustrated before being incorporated into a pouch.

As shown in FIGS. 33 and 34, a pouch 820 according to another aspect of the present invention, like pouch 720, includes a cavity 828 defined between only a single sheet portion 822 that is folded over on itself, rather than a pair of sheet portions that are secured together. An example of a sheet or sheet portion 822 that may be used to construct pouch 820 is illustrated in FIG. 32 in an unfolded condition. In order to crease pouch 820, sheet 822 is folded over along a fold line 862, which then defines the bottom 834 of pouch 820. Sheet portion 822 is also folded longitudinally along a fold line 864. This folding creates a rooftop or triangular shape in sheet 822, which can be seen in the cross sectional view of FIG. 34. In order to create this triangular shape, a sealed portion or seam 866 between the two sections of sheet 822 is created that has a smaller width $W_2$ than the width $W_1$ of sheet 822 when it is in a flat condition (as shown in FIG. 32). Stated alternatively, the sealing of the opposite portions of sheet 822 together takes place such that the width of the seam is less than the width of the sheet when laid flat. The reduction in width in the seam leaves a greater width in the non-sealed portions surrounding cavity 828, which allows the triangular shape of the cavity to be formed. As an alternative to the folding along line 864, which creates the triangular shape, multiple vertical fold line that are parallel to fold line 864 could be used. Or no fold line could be used. By creating the seam with a narrower width than the flat sheets, however, the sheet will bow outwards in the area of the cavity, thereby creating an enlarged volume for the cavity of the pouch.

Figure 36:
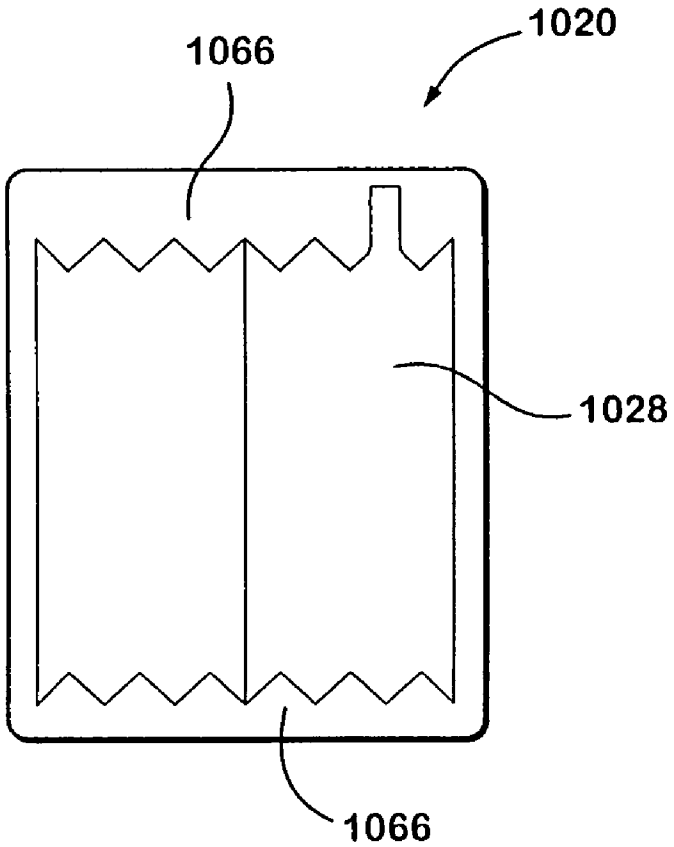
FIG. 36 is a plan view of a pouch according to another embodiment of the present invention.
Figure 35:
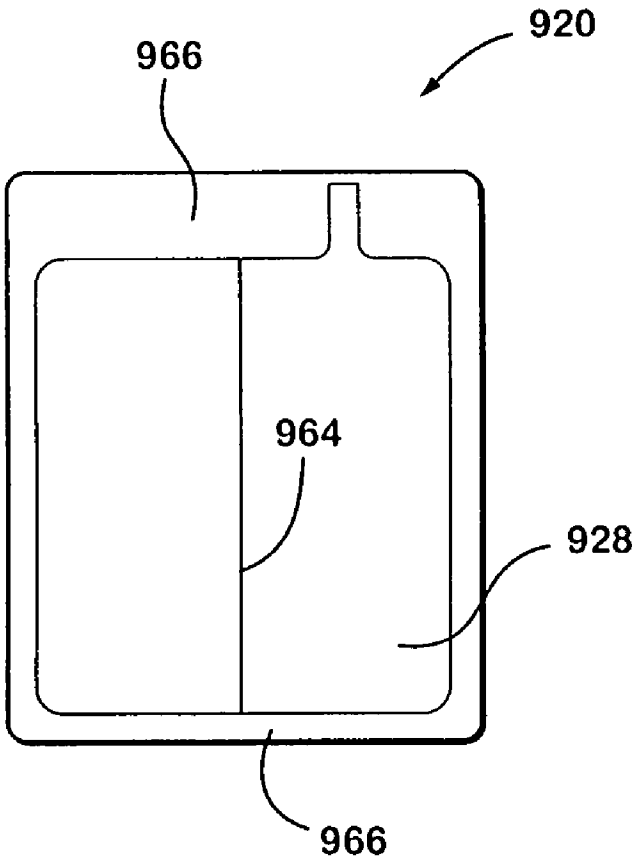
FIG. 35 is a plan view of a pouch according to another embodiment of the present invention.

FIGS. 35 and 36 depict two alternative variations of the pouch of the present invention. FIG. 35 depicts a pouch 920 that includes a seam 966 both above and below cavity 928. Pouch 920 may be constructed by using two sheets, rather than only a single sheet as described above with respect to pouch 820. Thus the two sheets are secured together both at a top and a bottom seam 966. As with pouch 820, these seams 966 are preferably of a narrower width than the width of the sheets when laid flat and sealed. A vertical fold line 964 is also included in pouch 920. These features cause cavity 928 to have a triangular shape, which rounds out when filled with product, generally similar to half of the triangular shape depicted in FIG. 34 discussed above. The pouch 1020 of FIG. 36 may be substantially the same as the pouch 920 of FIG. 35, with the exception that the seam 1066 has a generally saw-tooth shape. This saw-tooth shape helps accommodate excess material in the cavity 1028 at the seam 1066.

A pouch 1120 according to another aspect of the present invention is depicted in FIGS. 37 and 38. FIG. 37 depicts the front side of the pouch 1120 and FIG. 38 depicts the reverse side of the pouch 1120. As can be seen, pouch 1120 includes a graphical picture 1148 of a brake fluid can. A front side of the can is depicted in FIG. 37, while the opposite side of the cam is depicted in FIG. 38. The can illustration generally includes a can body that takes up substantially the entire surface area of the lower two-thirds of the pouch 1120. A neck portion is positioned on top of the can body portion. A cap 1150 is depicted as being attached to the top of the neck portion. Preferably, the picture 1148 of the can body, can neck, and can cap generally coincides with the shape and position of the underlying cavity 1128 defined in pouch 1120. A hole 1168 is provided as part of pouch 1120 adjacent the depiction of the cap. Hole 1168 is provided to allow pouch 1120 to be hung on a conventional peg or "J" type hook. By hanging the pouch on such hooks, the pouch can be effectively stored and displayed at a retail environment in a space saving manner. While not illustrated in FIGS. 37 and 38, the depiction of a brake fluid can is preferably done using color variations. The visual appearance of the can picture therefore mimics closely the visual appearance of an actual can.

A score line 1136 is provided on the pouch 1120. Score line 1136 intersects the picture 1148 between the bottom of the cap drawing and the top of the neck portion of the picture 1148. Thus, when pouch 1120 is torn along score line 1136, the torn away section 1146 of the pouch 1120 will include that portion on which the cap drawing is printed. Removal of the tear-away section 1146 therefore creates the visual appearance that the printed cap has been removed. The words "tear here" may be printed adjacent one or more areas of the score line 1136. This printed instruction, along with the overall visual appearance of the cap and score line 1136, provides an immediately recognizable visual indication to the user as to how to gain access to the contents of the pouch 1120. Furthermore, after tear-away section 1146 has been removed along score line 1136, the contents of the cavity of pouch 1120 will exit out of a neck portion in the cavity that is preferably aligned with the pictured neck portion. Therefore, when the user expels the contents of the pouch, it will appear that the contents are exiting out of the open end of the can picture 1148.

In order to help facilitate the tearing of pouch 1120 along score line 1136, a picture of a thumb or fingertip 1170 is also provided on the front and back of pouch 1120. The fingertip picture 1170 preferably has a size and shape that mimics an actual fingertip or a thumb tip. While other dimensions may be used, the fingertip picture 1170 may have a height of approximately fifteen millimeters. It may have a length of approximately eighteen millimeters. Other dimensions can, of course, be used without affecting the scope of the present invention. Optionally, other graphics may also be used, such as a tea cup handle, to define picture 1170. Picture 1170 provides a clear visual indication of where a user might conveniently grasp pouch 1120 while attempting to tear away section 1146. The picture 1170 may be much more detailed than that depicted in FIGS. 37 and 38. For example, it may include color variations to provide a visual indication of a fingernail, and other visual qualities that clearly convey the image of a finger or a thumb tip.

While the cavities of the various pouch embodiments described herein can be used to store any flowable materials, they may be especially utilized to store brake fluid, greases, lubricants, adhesives, creams, food products, cleaners, fragrances, and other flowable materials. Each cavity may desirably be constructed to store a volume of flowable product of roughly about 0.25 to about 8 ounces or thereabouts, although other volumes may be used, depending on the material and its application. Because the various pouches described herein can be manufactured in a relatively economical manner, it is possible to use these pouches to sell small quantities of a material at a meaningfully reduced price with respect to larger containers, or to use as trial samples of a product.

While the present invention has been described herein in terms of a number of different embodiments, it will be understood that the invention is not limited to these particular embodiments. In addition to other changes to the specific embodiments depicted herein, the present invention contemplates mixing any of the various features of the different pouch embodiments with any of the other pouch embodiments. Thus, as but one example, the gussets 354 of pouch 320 (FIGS. 20 and 21) could be incorporated into a pouch having a container picture printed on one side, such as is illustrated on pouch 224" (FIG. 19). As another example, visual pictures of containers like those of FIGS. 1–9, 37 and 38 could be used on any of the other pouches. Other combinations of features from the different pouch versions are also possible, including using only a single sheet to folded over on itself to create the cavity, rather than two sheets secured together. Still further, additional modifications can be made to the pouch embodiments described herein and the invention includes any and all modifications that are within its spirit and scope as defined in the appended claims.

Therefore, the present invention provides a compartmentalized pouch or container with a header portion and separate pockets or cavities and supporting graphics for each pocket or /. The graphics may include tear off and application guidelines and other information pertaining to the adhesive product (or other flowable material or product) contained within the cavities. The individual cavities or pockets provide a single use dispenser for dispensing the quick drying adhesive or flowable material. The compartmentalized container may also include a brush or applicator to spread out the adhesive or flowable material dispensed from the dispensers. The applicator brush provides a disposable spreader which is readily accessible when applying the adhesive from the cavity of the dispenser, and thus reduces the likelihood that a person will use their finger or other object to spread the adhesive. The applicator may be defined by supporting graphics or by a roughened edge or the like along the edge or region of the container. The applicator brush, or other icon or drawing or roughened edge indicative of such an applicator or spreader, may be placed anywhere on the dispenser, without affecting the scope of the present invention.

The header portion is integral with the separable dispensers and may provide details on the UPC code, application directions, hazard warnings, promotional/advertising information or print or the like, and may further include a hole or other means for hanging the compartmentalized container at the store. The header portion may contain essential and/or important material that may not be conveniently or legibly placed on each small, single use adhesive dispenser that is physically attached to and part of the header portion and compartmentalized container and that are detachable as separate single use dispensing units.

Because each of the individual adhesive dispensers are intended for single use and contain a small amount of quick driving adhesive or other flowable material and do not include a resealing cap or the like, the present invention avoids the resealing problems or second use problems typically associate with conventional adhesive dispensing tubes. The single use dispensers are unitary or integral with the header portion, which may provide product information and a means for readily hanging or displaying the dispensers at a store or workshop. The single use packages or dispensers of the present invention thus are very economical and do not require special packaging to contain multiple dispensers for sale as a package.

Changes and modifications in the specifically described embodiments may be carried out without departing from the principles of the present invention, which is intended to be limited only by the scope of the appended claims, as interpreted according to the principles of patent law.

The embodiments of the invention in which an exclusive property or privilege is claimed are defined as follows:

1. A compartmentalized container for containing at least one flowable material, said container being formed from opposite sheet portions selectively sealed together, said compartmentalized container comprising:

a header portion, said opposite sheet portions of said header portion being substantially sealed together, at least one side of said header portion providing information about said flowable material;

a first dispenser adjacent to said header portion, said opposite sheet portions of said first dispenser being selectively sealed together to define a closed cavity for containing said flowable material; and a second dispenser adjacent to said first dispenser and adjacent to a portion of said first dispenser that is generally opposite from said header portion so that said first dispenser is located generally between said header portion and said second dispenser, said opposite sheet portions of said second dispenser being selectively sealed together to define a closed cavity for containing said flowable material, said header portion and said first and second dispensers being integrally formed by said opposite sheet portions, each of said first and second dispensers being separable from said compartmentalized container and openable to dispense said flowable material from a respective one of said cavities, wherein each of said first and second dispensers includes a dispensing tip at one end, said dispensing tip being defined by a narrow end portion of the respective cavity, said dispenser being opened via cutting or tearing said sheet portions at said dispensing tip.

2. The compartmentalized container of claim 1, wherein each of said first and second dispensers includes an applicator portion at an end of said dispenser opposite said dispensing tip, said applicator portion being configured to assist in applying said flowable material to an object.

3. A compartmentalized container for containing at least one flowable material, said container being formed from opposite sheet portions selectively sealed together, said compartmentalized container comprising:

a header portion, said opposite sheet portions of said header portion being substantially sealed together, at least one side of said header portion providing information about said flowable material;

a first dispenser adjacent to said header portion, said opposite sheet portions of said first dispenser being selectively sealed together to define a closed cavity for containing said flowable material; and a second dispenser adjacent to said first dispenser and adjacent to a portion of said first dispenser that is generally opposite from said header portion so that said first dispenser is located generally between said header portion and said second dispenser, said opposite sheet portions of said second dispenser being selectively sealed together to define a closed cavity for containing said flowable material, said header portion and said first and second dispensers being integrally formed by said opposite sheet portions, wherein each of said first and second dispensers includes an applicator portion, said applicator portion being configured to assist in applying said flowable material to an object.

4. The compartmentalized container of claim 3, wherein said applicator portion comprises a roughened edge of said sheet portions.

5. The compartmentalized container of claim 3, wherein said applicator portion is graphically defined on at least one of said opposite sheet portions.

6. The compartmentalized container of claim 3, wherein said applicator portion comprises an extended applicator portion extending from an edge portion of said dispenser.

7. A compartmentalized container for containing at least one flowable material, said container being formed from opposite sheet portions selectively sealed together, said compartmentalized container comprising:

a header portion, said opposite sheet portions of said header portion being substantially sealed together, at least one side of said header portion providing information about said flowable material;

a first dispenser adjacent to said header portion, said opposite sheet portions of said first dispenser being selectively sealed together to define a closed cavity for containing said flowable material;

a second dispenser adjacent to said first dispenser and adjacent to a portion of said first dispenser that is generally opposite from said header portion so that said first dispenser is located generally between said header portion and said second dispenser, said opposite sheet portions of said second dispenser being selectively sealed together to define a closed cavity for containing said flowable material, said header portion and said first and second dispensers being integrally formed by said opposite sheet portions; and wherein said flowable material of said first dispenser is different than said flowable material of said second dispenser, and wherein said flowable materials are mixable together to form a mixture, said first and second dispensers being foldable together along a separating line between said first and second dispensers such that said flowable materials are mixed together as they are dispensed from said first and second dispensers.

8. A compartmentalized container for containing at least one flowable material, said container being formed from opposite sheet portions selectively sealed together, said compartmentalized container comprising:

a header portion, said opposite sheet portions of said header portion being substantially sealed together at least one side of said header portion providing information about said flowable material;

a first dispenser adjacent to said header portion, said opposite sheet portions of said first dispenser being selectively sealed together to define a closed cavity for containing said flowable material; and a second dispenser adjacent to said first dispenser and adjacent to a portion of said first dispenser that is generally opposite from said header portion so that said first dispenser is located generally between said header portion and said second dispenser, said opposite sheet portions of said second dispenser being selectively sealed together to define a closed cavity for containing said flowable material, said header portion and said first and second dispensers being integrally formed by said opposite sheet portions; and wherein said flowable material of said first dispenser is different than said flowable material of said second dispenser, and wherein said opposite sheet portions are selectively sealed together to define a frangible sealed portion between said cavities of said first and second dispensers, said flowable materials being mixable within said cavity of one of said first and second dispensers and the mixture being dispensable from said one of said first and second dispensers.

9. The compartmentalized container of claim 8, wherein one of said opposite sheet portions comprises an at least partially transparent portion at said one of said first and second dispensers for viewing said mixture of said flowable materials.

10. The compartmentalized container of claim 9, wherein said flowable material of said first dispenser is a different color than said flowable material of said second dispenser.

11. A compartmentalized container for containing at least one flowable material, said container being formed from opposite sheet portions selectively sealed together, said compartmentalized container comprising:

a header portion, said opposite sheet portions of said header portion being substantially sealed together, at least one side of said header portion providing information about said flowable material;

a first dispenser adjacent to said header portion, said opposite sheet portions of said first dispenser being selectively sealed together to define a closed cavity for containing said flowable material; and a second dispenser adjacent to said first dispenser and adjacent to a portion of said first dispenser that is generally opposite from said header portion so that said first dispenser is located generally between said header portion and said second dispenser, said opposite sheet portions of said second dispenser being selectively sealed together to define a closed cavity for containing said flowable material, said header portion and said first and second dispensers being integrally formed by said opposite sheet portions, wherein at least one of said opposite sheet portions includes a container image of a container printed on an external side of said sheet portion, said container image being representative of a bottle of said flowable material and having a body portion and a neck portion.

12. The compartmentalized container of claim 11, wherein each of said first and second dispensers is separable from said compartmentalized container and openable to dispense said flowable material from a respective one of said cavities.

13. The compartmentalized container of claim 12, wherein said dispensers are separable along a perforated joint between adjacent ones of said dispensers.

14. The compartmentalized container of claim 12, wherein said dispensers are separable along an indicating line printed on at least one of said sheet portions and between adjacent ones of said dispensers.

15. The compartmentalized container of claim 11, wherein said header portion includes at least some printed information about said flowable material thereon.

16. The compartmentalized container of claim 11, wherein said header portion includes a means for hanging said compartmentalized container.

17. The compartmentalized container of claim 11, wherein each of said closed cavities contain a quick-drying adhesive, each of said adhesive dispensers being separable from said container and openable to dispense said quick-drying adhesive from a respective one of said cavities.

18. The compartmentalized container of claim 17, wherein said quick drying adhesive comprises one of ethyl cyanoacrylate and methyl cyanoacrylate.

19. The compartmentalized container of claim 11, wherein said flowable material of said first dispenser is different than said flowable material of said second dispenser.

20. The compartmentalized container of claim 11, wherein said container image comprises first and second container images positioned at respective ones of said first and second dispensers, said body portion of each of said first and second container images being positioned generally over a respective one of said cavities and said neck portion of each of said first and second container images being positioned over a dispensing tip of said respective cavity so that said neck portion and said dispensing tip are generally aligned and any material in said cavity appears to be exiting out of said neck portion of said first or second container image when said flowable material is expelled from said first or second dispenser through said dispensing tip of said first or second dispenser, said dispensing tip having a narrower width than said cavity and being located adjacent the outer periphery of said dispenser.

21. The compartmentalized container of claim 20, wherein the other of said opposite sheet portions includes a large image of a large container substantially over the external side of said other of said opposite sheet portions.

22. A compartmentalized container for containing at least one flowable material, said container being formed from opposite sheet portions selectively sealed together, said compartmentalized container comprising:

a header portion, said opposite sheet portions of said header portion being substantially sealed together, said header portion including a means for hanging said compartmentalized container;

a first dispenser adjacent to said header portion, said opposite sheet portions of said first dispenser being selectively sealed together to define a closed cavity for containing said flowable material, said cavity including a narrowed portion at a periphery of said first dispenser, said narrowed portion being configured for dispensing said flowable material from said cavity when said narrowed portion is opened, wherein one of said opposite sheet portions includes a first image of a container printed on an external side of said sheet portion, said first image having a body portion and a neck portion and positioned at said first dispenser, said body portion of said first image being positioned over said narrowed portion of said cavity so that said neck portion and said narrowed portion are generally aligned and said flowable material in said cavity appears to be exiting out of said neck portion of said first image when said flowable material is expelled from said dispenser through said narrowed portion; and a second dispenser, said opposite sheet portions of said second dispenser being selectively sealed together to define a closed cavity for containing said flowable material, said cavity including a narrowed portion at a periphery of said second dispenser, said narrowed portion being configured for dispensing said flowable material from said cavity when said narrowed portion is opened, wherein said one of said opposite sheet portions includes a second image of a container printed on said external side of said sheet portion, said second image having a body portion and a neck portion and positioned at said second dispenser, said body portion of said second image being positioned generally over said cavity and said neck portion of said second image being positioned over said narrowed portion of said cavity so that said neck portion and said narrowed portion are generally aligned and said flowable material in said cavity appears to be exiting out of said neck portion of said second image when said flowable material is expelled from said dispenser through said narrowed portion, said header portion and said first and second dispensers being integrally formed by said opposite sheet portions.

23. The compartmentalized container of claim 22, wherein each of said first and second dispensers is separable from said compartmentalized container and openable to dispense said flowable material from a respective one of said cavities.

24. The compartmentalized container of claim 23, wherein said dispensers are separable along a perforated joint between adjacent ones of said dispensers.

25. The compartmentalized container of claim 23, wherein said dispensers are separable along an indicating line printed on at least one of said sheet portions and between adjacent ones of said dispensers.

26. The compartmentalized container of claim 23, wherein said narrowed end of said cavity of each of said first and second dispensers is openable via cutting or tearing said sheet portions at said narrowed portion.

27. The compartmentalized container of claim 22, wherein each of said first and second dispensers includes an applicator portion, said applicator portion being configured to assist in applying said flowable material to an object.

28. The compartmentalized container of claim 27, wherein said applicator portion comprises one of (a) a roughened edge of said sheet portions, (b) a graphical depiction on at least one of said opposite sheet portions, and (c) an extended applicator portion extending from an edge portion of said dispenser.

29. The compartmentalized container of claim 22, wherein each of said closed cavities contain a quick-drying adhesive, each of said adhesive dispensers being separable from said container and openable to dispense said quick-drying adhesive from a respective one of said cavities.

30. The compartmentalized container of claim 22, wherein said flowable material of said first dispenser is different than said flowable material of said second dispenser.

31. The compartmentalized container of claim 30, wherein each of said dispensers contains different flowable materials having at least one of (a) a different scent, (b) a different color, (c) a different taste and (d) a different use.

32. The compartmentalized container of claim 30, wherein said flowable materials are mixable together to form a mixture, said first and second dispensers being foldable together along a separating line between said first and second dispensers such that said flowable materials are mixed together as they are dispensed from said first and second dispensers.

33. The compartmentalized container of claim 22, wherein the other of said opposite sheet portions includes a large image of a large container substantially over the external side of said other of said opposite sheet portions.

34. The compartmentalized container of claim 22, wherein said opposite sheet portions comprise a tearable material adapted to allow a user to tear off a part of said first and second sheet portions intersecting said narrowed portion to thereby allow said flowable material to flow out of said cavity.

35. A compartmentalized container for containing at least two flowable materials, said container being formed from opposite sheet portions selectively sealed together, said compartmentalized container comprising:

a first dispenser, said opposite sheet portions of said first dispenser being selectively sealed together to define a closed cavity for containing a first flowable material, said cavity including a dispensing portion at a periphery of said first dispenser, said dispensing portion being configured for dispensing said flowable material from said cavity when said dispensing portion is opened, wherein one of said opposite sheet portions includes a first image of a container printed on an external side of said sheet portion, said first image having a body portion and a neck portion and positioned at said first dispenser, said body portion of said first image being positioned generally over said cavity and said neck portion of said first image being positioned over said dispensing portion of said cavity so that said neck portion and said dispensing portion are generally aligned and said flowable material in said cavity appears to be exiting out of said neck portion of said first image when said flowable material is expelled from said dispenser through said dispensing portion;

a second dispenser, said opposite sheet portions of said second dispenser being selectively sealed together to define a closed cavity for containing a second flowable material, said cavity including a dispensing portion at a periphery of said second dispenser, said dispensing portion being configured for dispensing said flowable material from said cavity when said dispensing portion is opened, wherein said one of said opposite sheet portions includes a second image of a container printed on said external side of said sheet portion, said second image having a body portion and a neck portion and positioned at said second dispenser, said body portion of said second image being positioned generally over said cavity and said neck portion of said second image being positioned over said dispensing portion of said cavity so that said neck portion and said dispensing portion are generally aligned and said flowable material in said cavity appears to be exiting out of said neck portion of said second image when said flowable material is expelled from said dispenser through said dispensing portion;

said first flowable material being different from said second flowable material, said first and second dispensers being integrally formed by said opposite sheet portions; and wherein each of said first and second dispensers is separable from said compartmentalized container and openable to dispense said first and second flowable materials from a respective one of said cavities.

36. The compartmentalized container of claim 35, wherein said dispensers are separable along a perforated joint between adjacent ones of said dispensers.

37. The compartmentalized container of claim 36, wherein said dispensers are separable along an indicating line printed on at least one of said sheet portions and between adjacent ones of said dispensers.

38. The compartmentalized container of claim 36, wherein each of said first and second dispensers includes a dispensing tip at said dispensing opening, said dispensing tip being defined by a narrow end portion of the respective cavity, said dispensing opening being opened via cutting or tearing said sheet portions at said dispensing tip.

39. The compartmentalized container of claim 38, wherein each of said first and second dispensers includes an applicator portion at an end of said dispenser opposite said dispensing tip, said applicator portion being configured to assist in applying said flowable material to an object.

40. The compartmentalized container of claim 35, wherein each of said first and second dispensers includes an applicator portion, said applicator portion being configured to assist in applying said flowable material to an object.

41. The compartmentalized container of claim 40, wherein said applicator portion comprises a roughened edge of said sheet portions.

42. The compartmentalized container of claim 40, wherein said applicator portion is graphically defined on at least one of said opposite sheet portions.

43. The compartmentalized container of claim 40, wherein said applicator portion comprises an extended applicator portion extending from an edge portion of said dispenser.

44. The compartmentalized container of claim 35 including a header portion, the opposite sheet portions of said header portion being substantially sealed together.

45. The compartmentalized container of claim 44, wherein said header portion includes a means for hanging said compartmentalized container.

46. The compartmentalized container of claim 35, wherein said first and second flowable materials are mixable together to form a mixture, said first and second dispensers being foldable together along a separating line between said first and second dispensers such that said first and second flowable materials are mixed together as they are dispensed from said first and second dispensers.

47. The compartmentalized container of claim 35, wherein said opposite sheet portions are selectively sealed together to define a frangible sealed portion between said cavities of said first and second dispensers, said first and second flowable materials being mixable within said cavity of one of said first and second dispensers and the mixture being dispensable from said one of said first and second dispensers.

48. The compartmentalized container of claim 47, wherein one of said opposite sheet portions comprises an at least partially transparent portion at said one of said first and second dispensers for viewing said mixture of said first and second flowable materials.

49. The compartmentalized container of claim 48, wherein said first flowable material comprises a different color material than said second flowable material.

50. The compartmentalized container of claim 35, wherein the other of said opposite sheet portions includes a large image of a large container substantially over the external side of the other of said opposite sheet portions.

51. A container for containing at least one flowable material, said container being formed from opposite sheet portions selectively sealed together, said container comprising:

a header portion, said opposite sheet portions of said header portion being substantially sealed together, said header portion including a means for hanging said compartmentalized container;

a dispenser adjacent to said header portion, said opposite sheet portions of said dispenser being selectively sealed together to define a closed cavity for containing said flowable material, said cavity including a dispensing portion at a periphery of said first dispenser, said dispensing portion being configured for dispensing said flowable material from said cavity when said dispensing portion is opened, wherein one of said opposite sheet portions includes an image of a container printed on an external side of said sheet portion, said image having a body portion and a neck portion and positioned at said dispenser, said body portion of said image being positioned generally over said cavity and said neck portion of said image being positioned over said dispensing portion of said cavity so that said neck portion and said dispensing portion are generally aligned and said flowable material in said cavity appears to be exiting out of said neck portion of said image when said flowable material is expelled from said dispenser through said dispensing portion; and wherein said header portion and said dispenser are integrally formed by said opposite sheet portions.

52. The container of claim 51, wherein said dispenser is separable from said header portion along a perforated joint between said dispenser and said header portion.

53. The container of claim 52, wherein said dispenser is separable along an indicating line printed on at least one of said sheet portions and between said dispenser and said header portion.

54. The container of claim 51, wherein said dispensing end of said cavity of said dispenser is openable via cutting or tearing said sheet portions at said dispensing portion.

55. The container of claim 51, wherein said dispenser includes an applicator portion, said applicator portion being configured to assist in applying said flowable material to an object.

56. The container of claim 55, wherein said applicator portion comprises one of (a) a roughened edge of said sheet portions, (b) a graphical depiction on at least one of said opposite sheet portions, and (c) an extended applicator portion extending from an edge portion of said dispenser.

57. The container of claim 51, wherein said opposite sheet portions comprise a tearable material adapted to allow a user to tear off a part of said first and second sheet portions intersecting said dispensing portion to thereby allow said flowable material to flow out of said cavity.

58. The container of claim 51, wherein said dispensing portion comprises a narrowed portion of said cavity.

* * * * *

UNITED STATES PATENT AND TRADEMARK OFFICE

CERTIFICATE OF CORRECTION

PATENT NO. : 7,241,066 B1
APPLICATION NO. : 10/818775
DATED : July 10, 2007
INVENTOR(S) : Ian K. Rosen et al.

It is certified that error appears in the above-identified patent and that said Letters Patent is hereby corrected as shown below:

Column 1
Line 14, “particular” should be --particularly--
Line 44, “user” should be --use--

Column 2
Line 17, “large” should be --larger--

Column 3
Line 56, “adhesives of” should be --adhesives or--

Column 5
Line 47, before “areas” and after “along” insert --other--

Column 7
Line 34, “tape” should be --type--
Line 44, “plane” should be --plan--

Column 9
Line 14, “of” in the first instance after “sheets” should be --or--

Column 13
Line 55, “adhesive” should be --container--

Column 14
Line 33, “pockets/dispenser” should be --pockets/dispensers--
Line 34, “pockets/dispenser” should be --pockets/dispensers--

Column 19
Line 40, “user” should be --use--

Column 21
Line 32, “by” should be --be--

Column 22
Line 20, “seal-sealing” should be --self-sealing--

UNITED STATES PATENT AND TRADEMARK OFFICE

CERTIFICATE OF CORRECTION

PATENT NO. : 7,241,066 B1
APPLICATION NO. : 10/818775
DATED : July 10, 2007
INVENTOR(S) : Ian K. Rosen et al.

It is certified that error appears in the above-identified patent and that said Letters Patent is hereby corrected as shown below:

Column 24
Line 4, “cam” should be --can--

Column 25
Line 31, “I” should be --cavity--
Line 62, “driving” should be --drying--

Column 27
Claim 8, Line 51, “together” should be “together,”

Column 29
Claim 22, Line 48, After “positioned” and before “over” insert --generally over said cavity and said neck portion of said first image being positioned--

Signed and Sealed this

Twentieth Day of January, 2009

JON W. DUDAS
*Director of the United States Patent and Trademark Office*